US007850098B2

(12) United States Patent
Vogel et al.

(10) Patent No.: US 7,850,098 B2
(45) Date of Patent: Dec. 14, 2010

(54) POWER SPRAYER

(75) Inventors: John D. Vogel, Columbus, IN (US); Michael Scot Rosko, Greenwood, IN (US); Patrick B. Jonte, Zionsville, IN (US); Ryan A. Reeder, Carmel, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 474 days.

(21) Appl. No.: 11/383,267

(22) Filed: May 15, 2006

(65) Prior Publication Data

US 2006/0255167 A1 Nov. 16, 2006

Related U.S. Application Data

(60) Provisional application No. 60/680,939, filed on May 13, 2005, provisional application No. 60/771,192, filed on Feb. 6, 2006.

(51) Int. Cl.

| | |
|---|---|
| ***B05B 1/34*** | (2006.01) |
| *B05B 1/14* | (2006.01) |
| *B05B 1/26* | (2006.01) |
| *B05B 1/32* | (2006.01) |
| *A62C 31/00* | (2006.01) |

(52) U.S. Cl. ..... 239/463; 239/590; 239/472; 239/461; 239/448; 239/449; 239/466; 239/447; 239/554; 239/383; 239/460; 239/470

(58) Field of Classification Search ..... 239/463, 239/590, 472, 461, 448, 449, 466, 447, 554, 239/383, 460, 470

See application file for complete search history.

(56) References Cited

U.S. PATENT DOCUMENTS

| | | | | | |
|---|---|---|---|---|---|
| 603,144 | A | | 4/1898 | Kellerman et al. | |
| 1,118,118 | A | * | 11/1914 | Fsicher | 239/475 |
| 1,254,748 | A | * | 1/1918 | Weidlich | 239/463 |
| 1,647,983 | A | | 11/1927 | Bloch | |
| 2,127,188 | A | * | 8/1938 | Schellin et al. | 239/440 |
| 2,313,994 | A | * | 3/1943 | Grant | 239/440 |
| 2,314,071 | A | | 3/1943 | Bucknell et al. | |
| 2,331,741 | A | * | 10/1943 | Smith | 239/441 |
| 2,416,737 | A | | 3/1947 | Budan | |
| 2,531,789 | A | * | 11/1950 | Rowley | 239/475 |
| 2,566,878 | A | | 9/1951 | Fahrenkrog et al. | |

(Continued)

FOREIGN PATENT DOCUMENTS

| | | |
|---|---|---|
| DE | 3306947 | 8/1984 |

(Continued)

OTHER PUBLICATIONS

Neoperl® Product Faucet Aerators, undated, 1 pg.

(Continued)

*Primary Examiner*—Len Tran
*Assistant Examiner*—Steven M Cernoch
(74) *Attorney, Agent, or Firm*—Baker & Daniels LLP

(57) ABSTRACT

A spray head for a power sprayer configured to generate a continuous sheet-like water shield around a center stream of water is disclosed. A water delivery device for use with a sink is disclosed, the water delivery device may produce a stream of water surrounded by a continuous shield of water.

28 Claims, 18 Drawing Sheets

U.S. PATENT DOCUMENTS

| | | | | | |
|---|---|---|---|---|---|
| 2,567,176 | A | | 9/1951 | Ballard | |
| 2,878,066 | A | * | 3/1959 | Erwin | 239/381 |
| 3,144,878 | A | | 8/1964 | Williams | |
| 3,337,134 | A | * | 8/1967 | Bond | 239/19 |
| 3,341,132 | A | | 9/1967 | Parkison | |
| 3,485,451 | A | * | 12/1969 | Gore et al. | 239/383 |
| 3,524,591 | A | | 8/1970 | Samuels et al. | |
| 3,545,473 | A | | 12/1970 | Mola | |
| 3,554,451 | A | | 1/1971 | Aghnides | |
| 3,588,040 | A | | 6/1971 | Ward | |
| 3,591,083 | A | | 7/1971 | O'Rear | |
| 3,656,503 | A | | 4/1972 | Ward | |
| 3,682,392 | A | | 8/1972 | Kint | |
| 3,685,541 | A | | 8/1972 | Caparone et al. | |
| 3,698,644 | A | | 10/1972 | Nystuen | |
| 3,722,525 | A | | 3/1973 | Epple | |
| 3,730,440 | A | | 5/1973 | Parkison | |
| 3,768,735 | A | | 10/1973 | Ward | |
| 3,786,995 | A | | 1/1974 | Manoogian et al. | |
| 3,851,825 | A | | 12/1974 | Parkison et al. | |
| 3,902,671 | A | | 9/1975 | Symmons | |
| 3,944,141 | A | | 3/1976 | Siczek | |
| 4,029,119 | A | | 6/1977 | Klieves | |
| 4,052,002 | A | | 10/1977 | Stouffer et al. | |
| 4,078,726 | A | * | 3/1978 | Walto | 239/205 |
| 4,119,276 | A | | 10/1978 | Nelson | |
| 4,128,206 | A | * | 12/1978 | Bintner | 239/11 |
| 4,132,362 | A | | 1/1979 | Hyde et al. | |
| 4,145,004 | A | | 3/1979 | Krizik | |
| 4,221,337 | A | | 9/1980 | Shames et al. | |
| 4,224,962 | A | | 9/1980 | Orszullok | |
| 4,257,460 | A | | 3/1981 | Paranay et al. | |
| 4,346,844 | A | * | 8/1982 | Harmony | 239/381 |
| 4,396,156 | A | | 8/1983 | Southworth et al. | |
| 4,398,669 | A | * | 8/1983 | Fienhold | 239/447 |
| 4,421,269 | A | | 12/1983 | Ts'ao | |
| 4,461,052 | A | | 7/1984 | Mostul | |
| 4,470,546 | A | | 9/1984 | Wildfang | |
| 4,516,753 | A | | 5/1985 | Thomsen | |
| 4,524,911 | A | | 6/1985 | Rozniecki | |
| 4,534,512 | A | | 8/1985 | Chow et al. | |
| 4,534,513 | A | | 8/1985 | Aghnides | |
| 4,534,514 | A | | 8/1985 | Aghnides | |
| 4,537,360 | A | * | 8/1985 | Bock | 239/553.3 |
| 4,541,568 | A | | 9/1985 | Lichfield | |
| 4,570,860 | A | * | 2/1986 | Aprea et al. | 239/478 |
| 4,582,253 | A | | 4/1986 | Gerdes | |
| 4,606,370 | A | | 8/1986 | Geipel et al. | |
| 4,618,100 | A | * | 10/1986 | White et al. | 239/440 |
| 4,619,403 | A | | 10/1986 | Goldney et al. | |
| 4,629,124 | A | | 12/1986 | Gruber | |
| 4,650,120 | A | | 3/1987 | Kress | |
| 4,653,693 | A | | 3/1987 | Steingass | |
| 4,666,085 | A | | 5/1987 | Liaw | |
| 4,682,728 | A | | 7/1987 | Oudenhoven et al. | |
| 4,700,884 | A | | 10/1987 | Barrett et al. | |
| 4,703,893 | A | | 11/1987 | Gruber | |
| 4,712,591 | A | | 12/1987 | McCann et al. | |
| 4,776,517 | A | | 10/1988 | Heren | |
| 4,785,998 | A | | 11/1988 | Takagi | |
| 4,789,103 | A | | 12/1988 | Ruhnke | |
| 4,795,092 | A | | 1/1989 | Fuller | |
| 4,823,409 | A | | 4/1989 | Gaffney et al. | |
| 4,830,280 | A | | 5/1989 | Yankoff | |
| RE32,981 | E | | 7/1989 | Marty | |
| 4,854,498 | A | | 8/1989 | Stayton | |
| 4,854,545 | A | | 8/1989 | Pezzarossi | |
| 4,869,287 | A | | 9/1989 | Pepper et al. | |
| 4,869,427 | A | | 9/1989 | Kawamoto et al. | |
| 4,886,210 | A | | 12/1989 | Gaffney et al. | |
| 4,893,653 | A | | 1/1990 | Ferrigno | |
| 4,909,443 | A | | 3/1990 | Takagi | |
| 4,923,116 | A | | 5/1990 | Homan | |
| 4,927,115 | A | | 5/1990 | Bahroos et al. | |
| 4,934,402 | A | | 6/1990 | Tarnay et al. | |
| 4,945,943 | A | | 8/1990 | Cogger | |
| 4,955,546 | A | | 9/1990 | Liaw | |
| 4,986,475 | A | | 1/1991 | Spadafora et al. | |
| 4,997,131 | A | | 3/1991 | Heren | |
| 5,014,919 | A | | 5/1991 | Knapp | |
| 5,040,106 | A | | 8/1991 | Maag | |
| 5,052,587 | A | | 10/1991 | Graves | |
| 5,069,241 | A | | 12/1991 | Hochstrasser | |
| 5,093,943 | A | | 3/1992 | Wei | |
| 5,100,055 | A | | 3/1992 | Rokitenetz et al. | |
| 5,124,934 | A | | 6/1992 | Kawamoto et al. | |
| 5,143,299 | A | | 9/1992 | Simonetti et al. | |
| 5,145,114 | A | | 9/1992 | Mönch | |
| 5,148,824 | A | | 9/1992 | Wilson et al. | |
| 5,158,234 | A | | 10/1992 | Magnenat et al. | |
| 5,160,086 | A | | 11/1992 | Kuykendal et al. | |
| 5,160,092 | A | | 11/1992 | Rose et al. | |
| 5,170,361 | A | | 12/1992 | Reed | |
| 5,170,816 | A | | 12/1992 | Schnieders | |
| 5,172,866 | A | * | 12/1992 | Ward | 239/446 |
| 5,184,777 | A | | 2/1993 | Magnenat et al. | |
| 5,201,468 | A | | 4/1993 | Freier et al. | |
| 5,232,162 | A | | 8/1993 | Chih | |
| 5,242,119 | A | | 9/1993 | Jariyasunant | |
| 5,255,848 | A | | 10/1993 | Rhodehouse | |
| 5,256,287 | A | | 10/1993 | Underwood | |
| 5,287,570 | A | | 2/1994 | Peterson et al. | |
| 5,323,968 | A | | 6/1994 | Kingston et al. | |
| 5,333,792 | A | | 8/1994 | Wang | |
| 5,348,228 | A | | 9/1994 | Wang | |
| 5,348,231 | A | | 9/1994 | Arnold et al. | |
| 5,370,314 | A | | 12/1994 | Gebauer et al. | |
| 5,383,604 | A | | 1/1995 | Boesch | |
| 5,398,872 | A | | 3/1995 | Joubran | |
| 5,433,384 | A | | 7/1995 | Chan et al. | |
| 5,445,182 | A | | 8/1995 | Sturman et al. | |
| 5,467,927 | A | | 11/1995 | Lee | |
| 5,467,929 | A | | 11/1995 | Bosio | |
| 5,467,967 | A | | 11/1995 | Gillooly | |
| 5,486,383 | A | | 1/1996 | Nowotarski et al. | |
| 5,542,449 | A | | 8/1996 | Huang | |
| 5,551,635 | A | * | 9/1996 | Jager | 239/240 |
| 5,630,548 | A | | 5/1997 | Chih | |
| 5,634,220 | A | | 6/1997 | Chiu | |
| 5,641,120 | A | | 6/1997 | Kuykendal et al. | |
| 5,647,537 | A | | 7/1997 | Bergmann | |
| 5,649,562 | A | | 7/1997 | Sturman et al. | |
| 5,662,273 | A | | 9/1997 | Chih | |
| 5,662,276 | A | | 9/1997 | Ko | |
| 5,669,558 | A | | 9/1997 | Ichel | |
| 5,707,011 | A | | 1/1998 | Bosio | |
| 5,722,597 | A | | 3/1998 | Guo | |
| 5,732,884 | A | | 3/1998 | Jauner | |
| 5,772,120 | A | | 6/1998 | Huber | |
| 5,794,854 | A | | 8/1998 | Yie | |
| 5,806,770 | A | | 9/1998 | Wang | |
| 5,806,771 | A | | 9/1998 | Loschelder et al. | |
| 5,823,229 | A | | 10/1998 | Bertrand et al. | |
| 5,829,681 | A | | 11/1998 | Hamel et al. | |
| 5,858,215 | A | | 1/1999 | Burchard et al. | |
| 5,873,531 | A | | 2/1999 | Wang | |
| 5,873,647 | A | * | 2/1999 | Kurtz et al. | 362/96 |
| 5,887,796 | A | | 3/1999 | Dimmer | |
| 5,889,684 | A | | 3/1999 | Ben-David et al. | |
| 5,918,816 | A | | 7/1999 | Huber | |
| 5,937,905 | A | | 8/1999 | Santos | |
| 5,971,299 | A | | 10/1999 | Loschelder et al. | |
| 5,975,429 | A | | 11/1999 | Jezek | |
| 5,975,432 | A | | 11/1999 | Han | |

5,979,776 A 11/1999 Williams
5,984,207 A 11/1999 Wang
6,000,626 A 12/1999 Futo et al.
6,000,637 A 12/1999 Duncan
6,003,170 A 12/1999 Humpert et al.
6,007,003 A 12/1999 Wang
6,016,975 A 1/2000 Amaduzzi
6,019,130 A 2/2000 Rump
6,029,094 A 2/2000 Diffut
6,039,269 A 3/2000 Mandzukic
6,045,062 A 4/2000 Bosio
6,059,200 A 5/2000 Chou
6,076,743 A 6/2000 Fan
6,085,790 A 7/2000 Humpert et al.
6,129,294 A 10/2000 Hsin-Fa
6,145,757 A 11/2000 Knapp
6,151,729 A 11/2000 Yean
6,158,152 A 12/2000 Nathenson et al.
6,164,566 A 12/2000 Hui-Chen
6,173,910 B1 1/2001 Yean
6,173,911 B1 1/2001 Hui-Chen
6,179,130 B1 1/2001 Nguyen et al.
6,216,965 B1 4/2001 Chao
6,220,297 B1 4/2001 Marty et al.
6,230,989 B1 5/2001 Haverstraw et al.
6,234,192 B1 5/2001 Esche et al.
6,247,654 B1 6/2001 Kuo
6,250,570 B1 * 6/2001 Starr et al. ..... 239/472
D445,874 S 7/2001 Czerwinski, Jr. et al.
6,254,016 B1 7/2001 Chao
6,260,772 B1 7/2001 Hennemann, Jr. et al.
6,260,774 B1 7/2001 Erickson
6,290,147 B1 9/2001 Bertrand et al.
6,290,149 B1 * 9/2001 Daniel et al. ..... 239/590
6,296,011 B1 10/2001 Esche et al.
6,302,339 B1 10/2001 Chou
6,305,619 B1 10/2001 Thurn
6,315,208 B1 11/2001 Doyle
6,341,389 B2 1/2002 Philipps-Liebich et al.
6,341,738 B1 1/2002 Coles
6,367,710 B2 4/2002 Fan
6,367,711 B1 4/2002 Benoist
6,368,503 B1 4/2002 Williamson et al.
6,370,713 B2 4/2002 Bosio
6,382,529 B1 5/2002 Wu
6,415,958 B1 7/2002 Donley
6,427,931 B1 8/2002 Guo
6,431,468 B1 8/2002 Brown et al.
6,446,875 B1 9/2002 Brooks et al.
6,454,186 B2 9/2002 Haverstraw et al.
6,454,187 B1 9/2002 Wang
6,460,782 B1 10/2002 Wang
6,471,141 B2 10/2002 Smith et al.
6,471,146 B1 10/2002 Kuykendal et al.
6,484,953 B2 * 11/2002 Freier ..... 239/461
6,502,768 B2 1/2003 Chang
6,508,415 B2 1/2003 Wang
6,513,787 B1 2/2003 Jeromson et al.
6,520,427 B1 2/2003 Chen
RE38,013 E 3/2003 Stouffer
6,540,159 B1 4/2003 Wang
6,540,163 B1 4/2003 Huang
6,561,439 B1 * 5/2003 Bonzer ..... 239/451
6,561,441 B1 5/2003 Hsieh
6,568,605 B1 5/2003 Chen
6,575,196 B1 * 6/2003 Creswell ..... 137/625.46
6,575,387 B1 6/2003 Baker
6,592,057 B1 7/2003 Ericksen et al.
6,595,440 B2 7/2003 Moriarty et al.
6,612,507 B1 9/2003 Meyer et al.
6,622,945 B1 9/2003 Wu et al.
6,629,645 B2 10/2003 Mountford et al.
6,631,525 B2 10/2003 Piatt et al.
6,634,573 B2 10/2003 Boesch et al.
6,641,060 B2 11/2003 Brattoli et al.
6,641,061 B1 11/2003 Hsieh
6,659,373 B1 12/2003 Heren et al.
6,663,022 B1 12/2003 Baker
6,685,110 B2 2/2004 Wang
6,691,933 B1 2/2004 Bosio
6,691,937 B2 2/2004 Heren et al.
6,694,544 B2 2/2004 Piatt
6,705,534 B1 3/2004 Mueller
6,705,549 B2 * 3/2004 Nakamura ..... 239/533.1
6,715,699 B1 4/2004 Greenberg et al.
6,719,219 B1 4/2004 Wang
6,730,177 B1 5/2004 Talley et al.
6,738,996 B1 5/2004 Malek et al.
6,739,523 B2 5/2004 Haverstraw et al.
6,749,135 B2 6/2004 Groblebe et al.
6,757,921 B2 7/2004 Esche
6,766,864 B2 * 7/2004 Clauss et al. ..... 169/46
6,786,240 B2 9/2004 Ouyoung
6,796,515 B2 9/2004 Heren et al.
6,808,130 B1 10/2004 Ouyoung
6,808,131 B2 * 10/2004 Bosio ..... 239/447
6,811,099 B2 11/2004 Krestine et al.
6,860,438 B1 3/2005 Huang
6,866,208 B2 3/2005 Kao
6,879,863 B2 4/2005 Mueller et al.
6,880,768 B2 4/2005 Lau
6,915,967 B1 7/2005 Chen
6,921,032 B2 7/2005 Habermacher et al.
6,945,474 B1 9/2005 Chen
6,962,298 B1 11/2005 Martin
6,964,404 B2 11/2005 Patterson et al.
6,964,405 B2 11/2005 Marcichow et al.
6,971,591 B2 12/2005 Fleischmann
6,981,661 B1 1/2006 Chen
7,000,266 B2 2/2006 Piatt et al.
7,000,626 B1 2/2006 Cress
7,000,854 B2 2/2006 Malek et al.
2001/0020302 A1 9/2001 Bosio
2002/0104906 A1 * 8/2002 Freier ..... 239/590
2002/0185553 A1 12/2002 Benstead et al.
2002/0190141 A1 12/2002 Huang
2003/0042331 A1 3/2003 Lu
2003/0042337 A1 * 3/2003 Liang et al. ..... 239/575
2003/0125842 A1 7/2003 Chang et al.
2003/0127541 A1 7/2003 Marino
2003/0178857 A1 8/2003 Roman
2003/0164415 A1 * 9/2003 Mitchell ..... 239/590
2003/0173423 A1 9/2003 Haenlein et al.
2003/0189111 A1 10/2003 Heren et al.
2004/0010848 A1 1/2004 Esche
2004/0074543 A1 4/2004 Dickson et al.
2004/0088786 A1 5/2004 Malek et al.
2004/0112985 A1 6/2004 Malek et al.
2004/0155460 A1 8/2004 Nobili
2004/0164183 A1 8/2004 Nobili
2004/0222320 A1 11/2004 Wu
2004/0227014 A1 11/2004 Williams et al.
2004/0227016 A1 * 11/2004 Yagi et al. ..... 239/524
2005/0072866 A1 * 4/2005 Petit ..... 239/590
2005/0103897 A1 5/2005 Cannon et al.
2005/0121542 A1 6/2005 Su Lim
2005/0145554 A1 7/2005 Cunningham et al.
2005/0161533 A1 7/2005 Nobili
2005/0178857 A1 8/2005 Roman
2005/0178858 A1 8/2005 Roman
2005/0189438 A1 9/2005 Bosio
2005/0242210 A1 11/2005 Heren et al.
2006/0016912 A1 1/2006 Nobili 2006/0022071 A1 2/2006 Burnworth et al.

FOREIGN PATENT DOCUMENTS

| | | |
|---|---|---|
| DE | 3643320 | 7/1988 |
| EP | 0251990 | 7/1988 |
| EP | 0933136 | 8/1999 |
| EP | 1132141 | 9/2001 |
| EP | 0809539 | 5/2003 |
| EP | 1354634 | 10/2003 |
| EP | 1418007 | 5/2004 |
| EP | 0975432 | 11/2005 |
| EP | 1598116 | 11/2005 |
| GB | 1452974 | 10/1976 |
| JP | 02-052061 | 2/1990 |
| JP | 9-52061 | 2/1997 |
| JP | 10-230192 | 9/1998 |
| JP | 11-21956 A | 1/1999 |
| JP | 2000-027247 | 1/2000 |
| WO | WO 80/01940 | 9/1980 |
| WO | WO 86/06654 | 11/1986 |
| WO | WO 96/25237 | 8/1996 |
| WO | WO 98/46366 | 10/1998 |
| WO | WO 2004/094990 | 11/2004 |
| WO | WO 2004/104305 | 12/2004 |
| WO | WO 2005/018814 | 3/2005 |
| WO | WO 2005/115554 | 12/2005 |

OTHER PUBLICATIONS

New Junior size aerators by Marie-Helene Perrin, Apr. 23, 2005, 1 pg.
Neoperl® Perlator Faucet Aerators, undated, 2 pgs.

* cited by examiner

POWER SPRAYER

CROSS REFERENCE TO RELATED APPLICATIONS

This application claims the benefit of U.S. Provisional Application Ser. No. 60/680,939, filed May 13, 2005 and U.S. Provisional Application Ser. No. 60/771,192, filed Feb. 6, 2006, the disclosures of which are expressly incorporated by reference herein.

BACKGROUND AND SUMMARY OF THE INVENTION

The present invention relates to a water delivery device and, more particularly, to a water delivery device for use with a sink and configured to generate a continuous sheet-like water shield around a stream of water.

According to illustrative embodiment of the present disclosure, a spray head includes a body, and a cartridge assembly received within the body. The cartridge assembly includes an inlet, a first outlet in fluid communication with the inlet and configured to produce a water stream, and a second outlet in fluid communication with the inlet and configured to produce a continuous shield of water extending outwardly in a sheet-like layer around the water stream, the water stream having a substantially laminar flow.

According to a further illustrative embodiment of the present disclosure, a spray head includes a body having a fluid port, and a mount removably received within the body. The spray head further includes a flow straightening member operably coupled to the mount and in fluid communication with the fluid port. The flow straightening member is configured to assist in removing turbulence from the water. A nozzle is operably coupled to the straightening member and includes an outlet orifice configured to produce a center water stream. A whirl member is operably coupled to the mount and is configured to impart rotational movement to the water, thereby producing a continuous shield of water extending around the center water stream.

According to yet another illustrative embodiment of the present disclosure, a method of generating a water pattern includes the steps of producing a center water stream having a substantially laminar flow from a first outlet, and producing an outer continuous shield of water extending outwardly in a sheet-like layer around the center water stream.

According to still a further illustrative embodiment of the present disclosure, a method of generating a water pattern with a water delivery device includes the steps of dividing a supply of water provided to the water delivery device into at least a first portion and a second portion and supplying from the water delivery device a stream of water based on the first portion and a continuous shield of water based on the second portion. The stream of water has a substantially laminar flow and the continuous shield of water surrounds the stream of water.

According to still another illustrative embodiment of the present disclosure, a water deliver system for connection to at least one source of water and for mounting to a sink deck is provided. The water delivery system comprises at least one valve adapted to be in communication with the at least one source of water and an output device coupled to the sink deck. The output device includes an internal waterway and a spray head. The internal waterway is in fluid communication with the valve and with the spray head. The spray head includes a first outlet producing a stream of water and a second outlet producing a continuous shield of water surrounding the stream of water.

Additional features and advantages of the present invention will become apparent to those skilled in the art upon consideration of the following detailed description of the illustrative embodiment exemplifying the best mode of carrying out the invention as presently perceived.

DETAILED DESCRIPTION OF THE DRAWINGS

Figure 1:
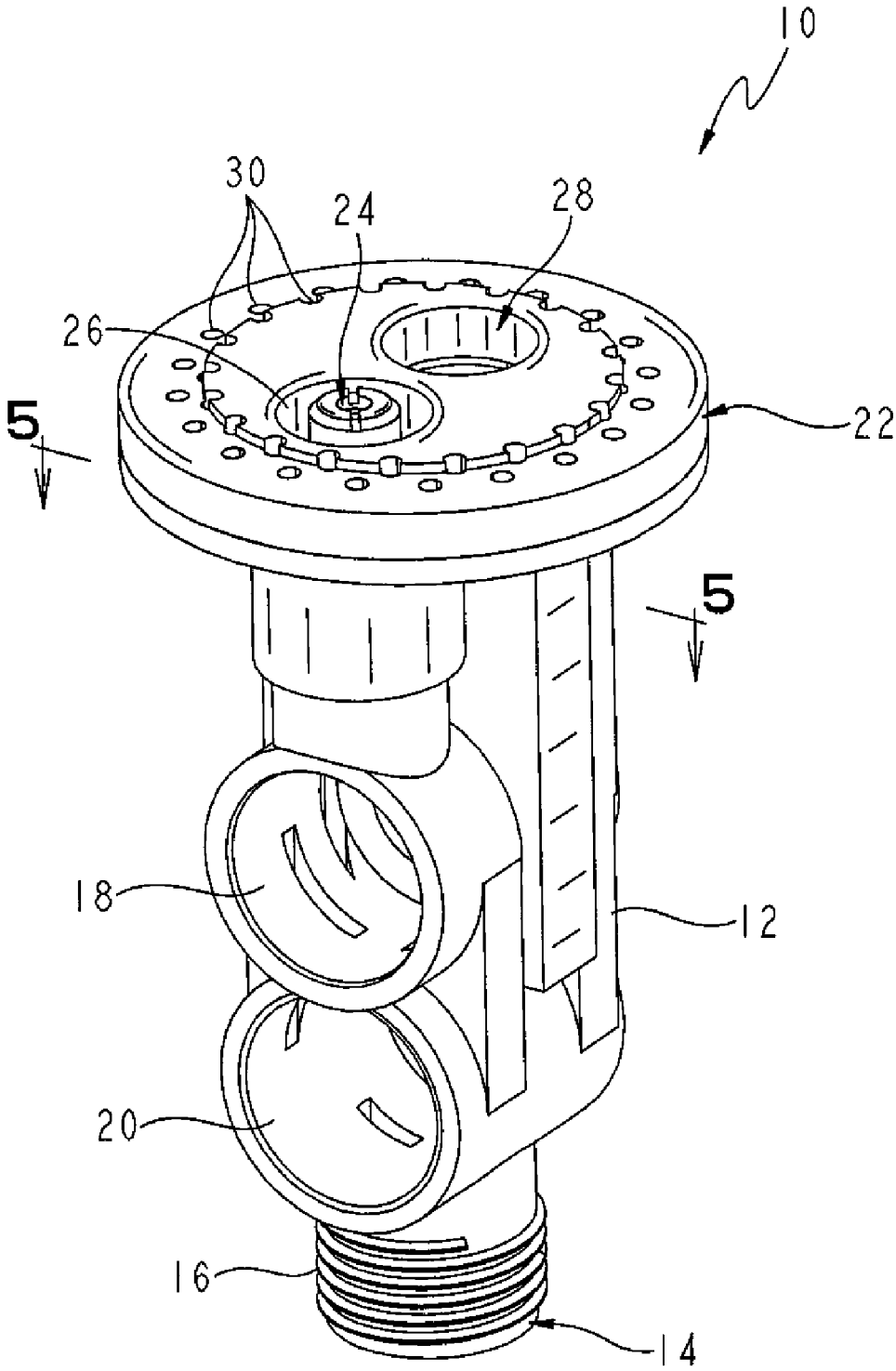
FIG. 1 is a front perspective view of an illustrative embodiment spray head of the present disclosure.
Figure 2:
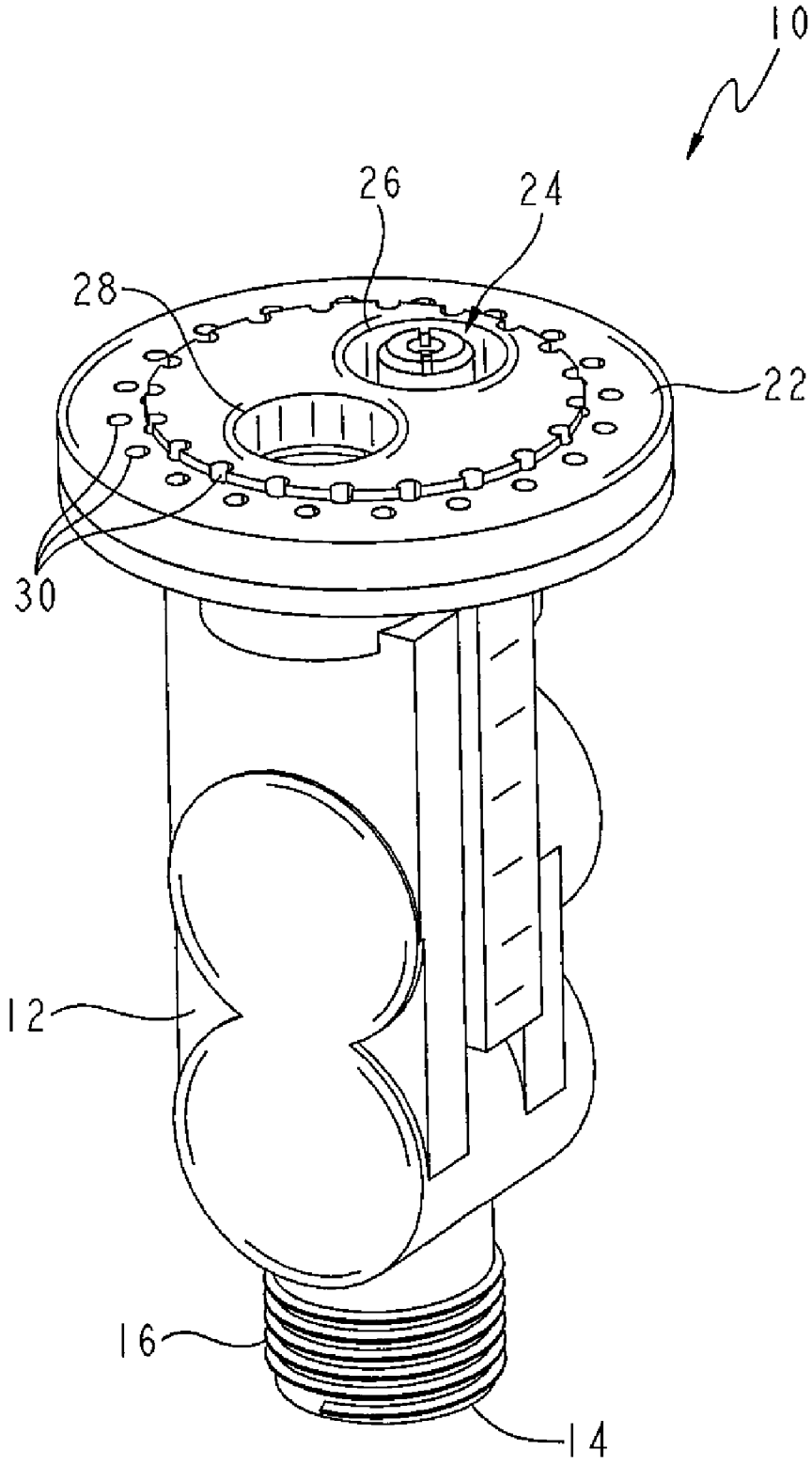
FIG. 2 is a rear perspective view of the spray head of FIG. 1.
Figure 3:
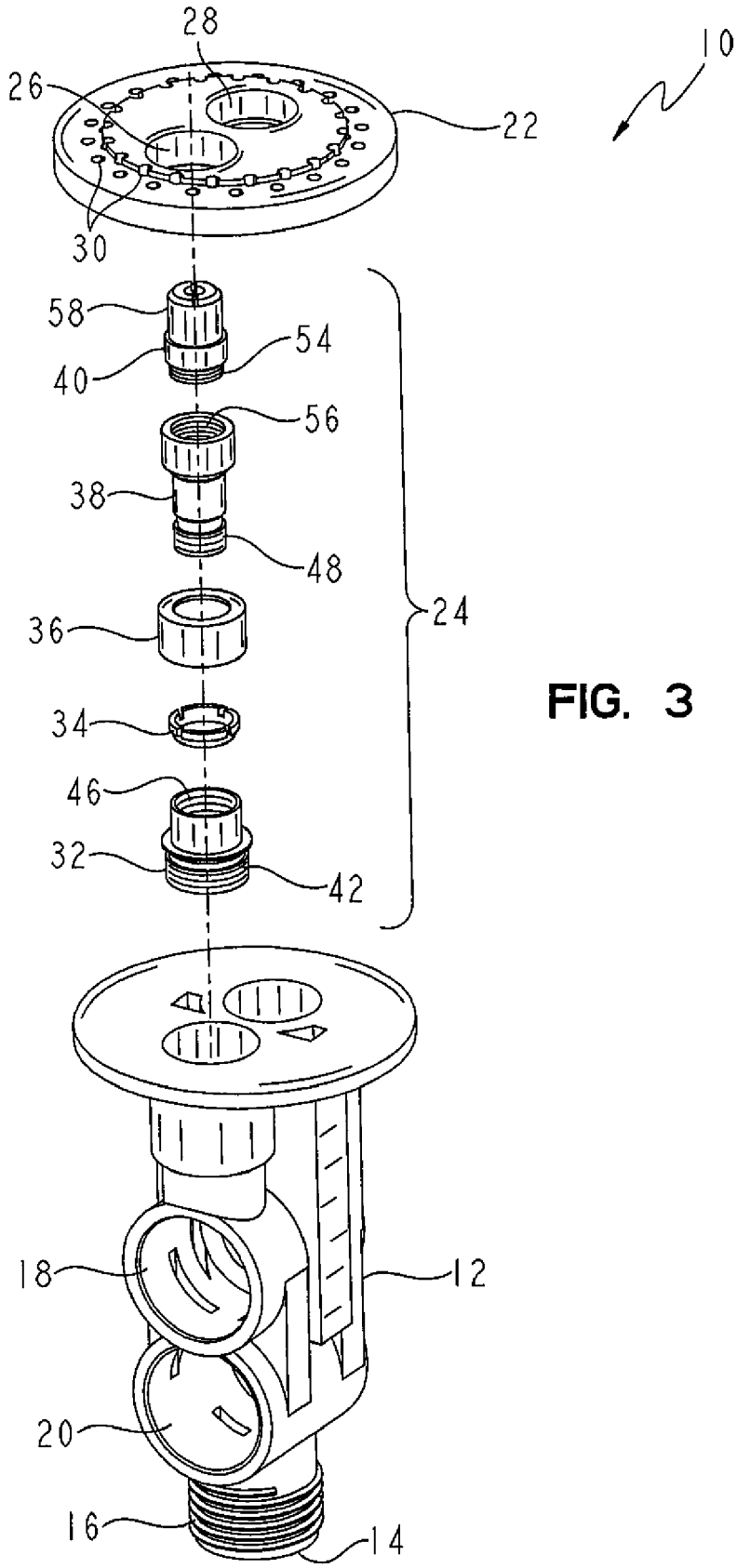
FIG. 3 is an exploded perspective view of the spray head of FIG. 1.

Referring initially to FIGS. 1-3, a spray head 10 according to an illustrative embodiment of the present invention is shown as including a valve body 12 including an inlet fluid port 14 having a plurality of external threads 16 for coupling with a conventional water supply line (not shown). A valve body 12 includes first and second bores 18 and 20 configured to receive conventional valve control members (not shown) for controlling the flow of water from the inlet fluid port 14 to an outlet member 22. More particularly, the valve control members are configured to direct water from the inlet fluid port 14 to different fluid passageways formed within the valve body 12, which are in fluid communication with a cartridge assembly 24 received within a first opening 26 of the outlet member 22, and aerator nozzle (not shown) received within a second opening 28 of the outlet plate 22, and a plurality of circumferentially disposed openings 30 positioned around the first and second openings 26 and 28.

Figure 4:
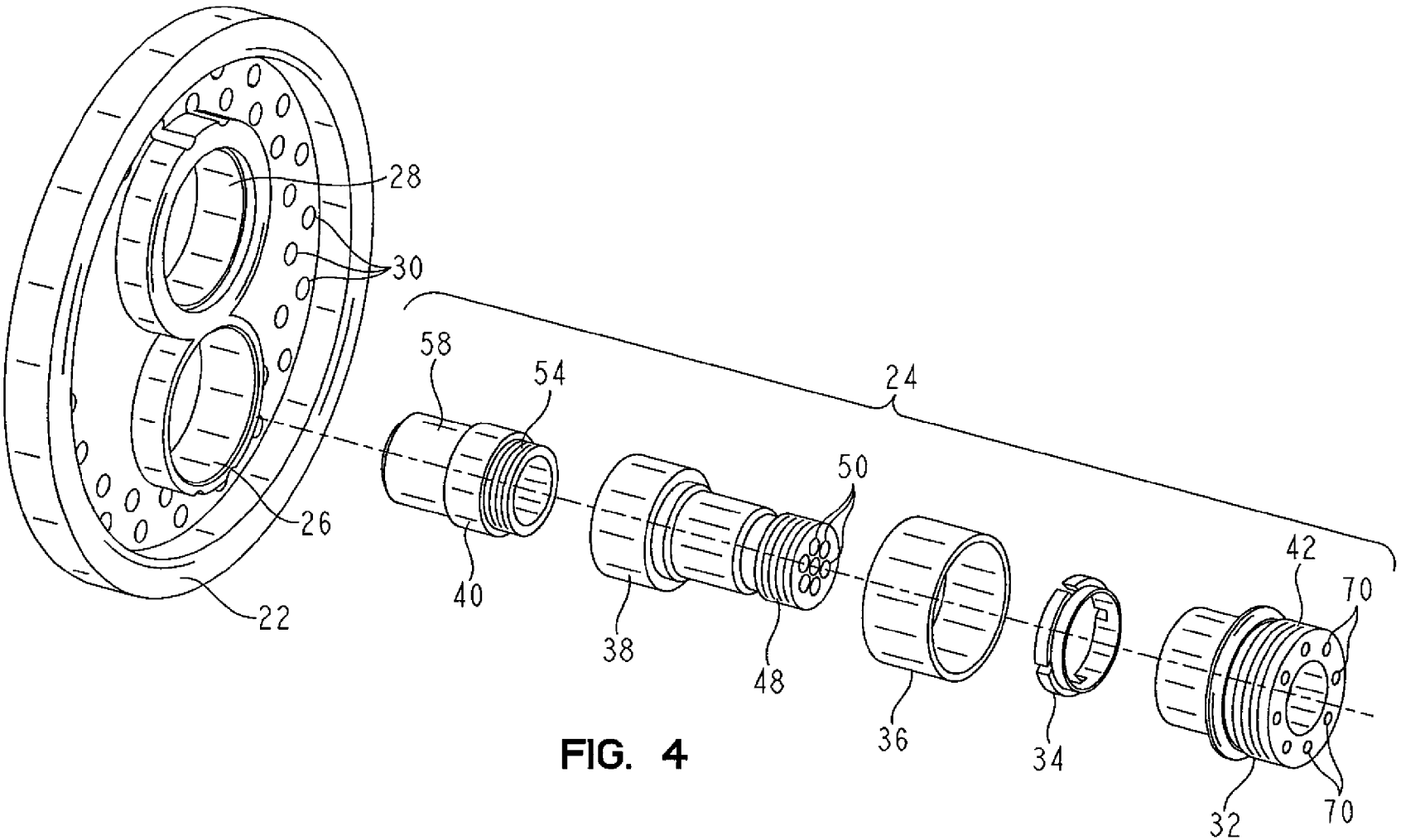
FIG. 4 is an exploded perspective view of the cartridge assembly and outlet member of the spray head of FIG. 1.
Figure 8:
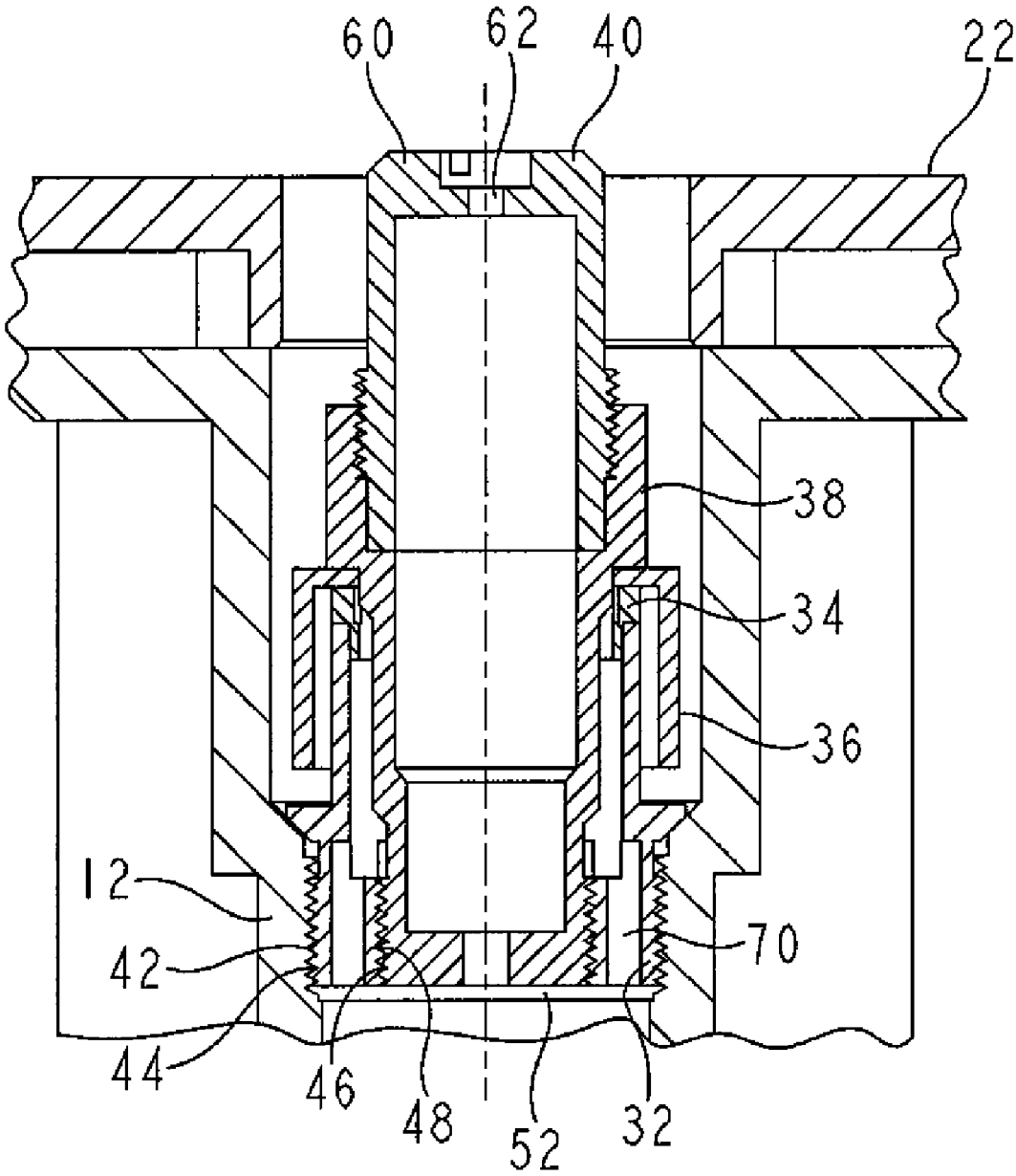
FIG. 8 is a detailed cross-sectional view of the cartridge assembly of FIG. 4.

Referring now to FIGS. 3 and 4, the cartridge assembly 24 includes a holder 32, a whirl member 34, a back reflector 36, a flow straightener 38 and a flow nozzle 40. The holder 32 includes an inner first end having a plurality of external threads 42 to be received within the opening 26 of the valve body 12 and to threadably engage a plurality of internal threads 44 formed therein (FIG. 8). An outer end of the holder 32 includes a plurality of internal threads 46 which threadably engage a plurality of external threads 48 formed on a inner end of the flow straightener 38 (FIG. 8).

Figure 5:
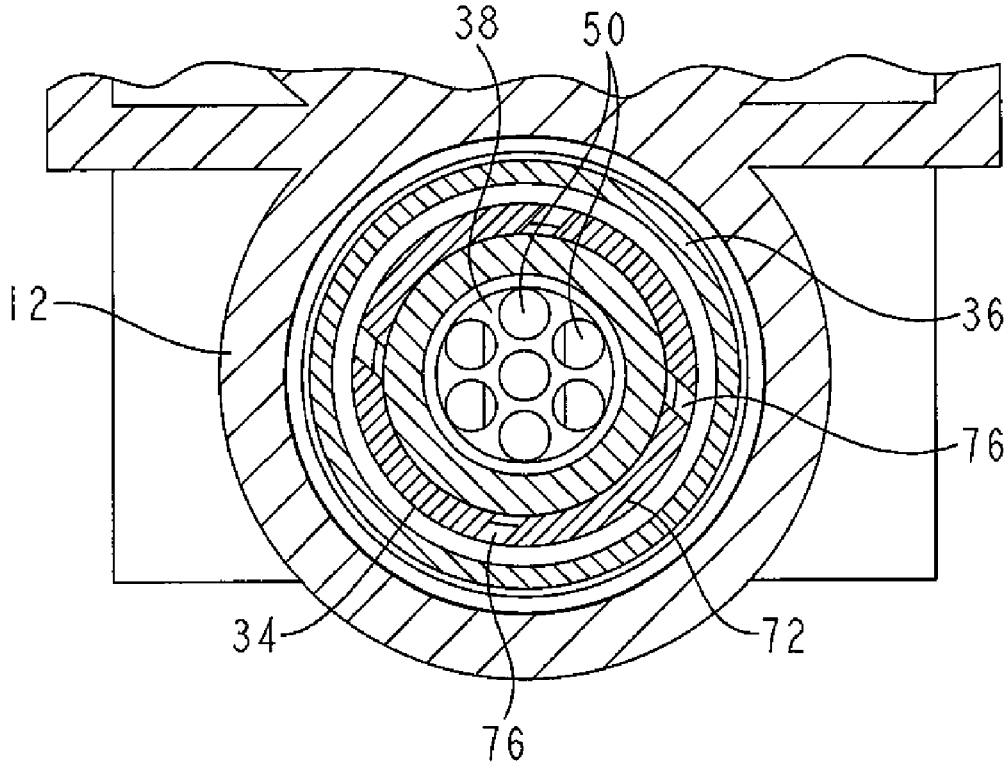
FIG. 5 is a cross-sectional view taken along line 5-5 of FIG. 1.
Figure 7:
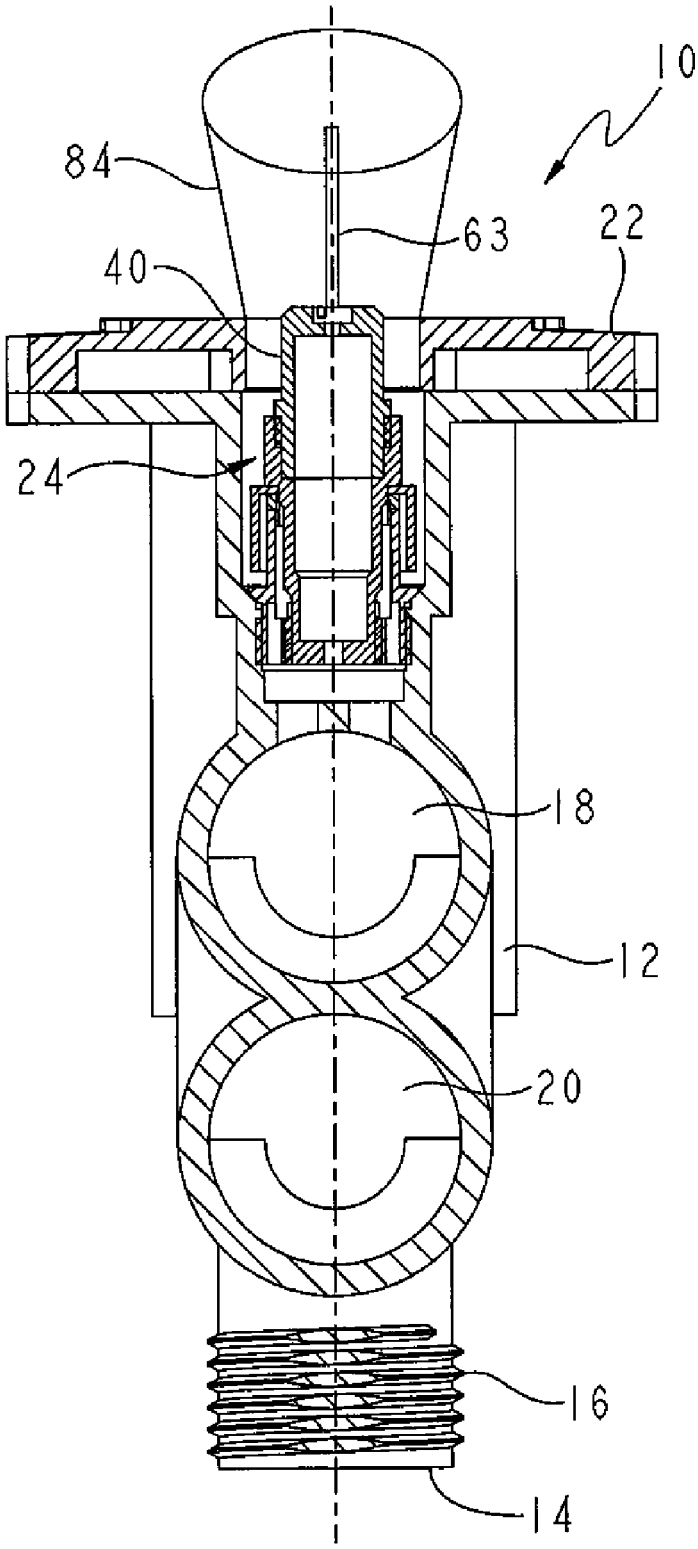
FIG. 7 is a cross-sectional view of the spray head of FIG. 1.
Figure 9:
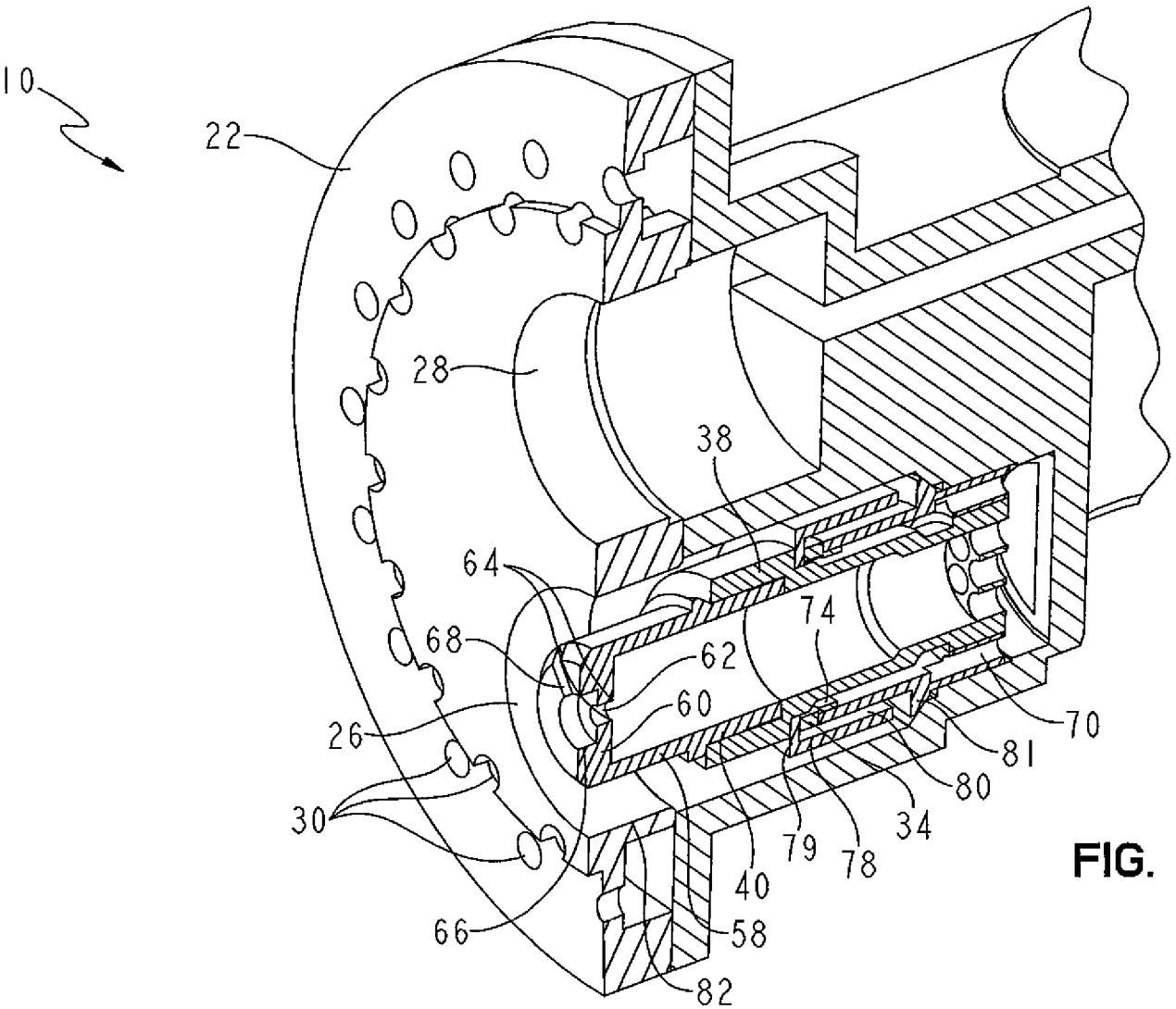
FIG. 9 is an end perspective view of the spray head of FIG. 1, with a partial cut-away thereof.

As shown in FIG. 8, the whirl member 34 and back reflector 36 are captured intermediate the flow straightener 38 and holder 32. Referring to FIG. 5, the flow straightener 38 includes a plurality of parallel, longitudinally aligned bores 50 configured to receive fluid from an inlet 52. The bores 50 are configured to assist in removing turbulence from water flowing therethrough, and provide a more linear flow to the water. Flow nozzle 40 includes an inner end having a plurality of internal threads 54 which threadably engage a plurality of internal threads 56 formed within the outer end of the flow straightener 38. Flow nozzle 40 includes a cylindrical outer wall 58 and a substantially planar end wall 60. An outlet orifice 62 is formed within the end wall 60 such that water passing therethrough forms a center water stream 63 (FIG. 7). The orifice 62 includes sharp entry corners 64 (see FIG. 9) to assist in providing a substantially laminar flow. Additionally, the diameter of the orifice 62 is illustratively at least as great as the thickness of the adjacent planar end wall 60 to further assist in providing a substantially laminar flow to the center water stream. A counter bore 66 is formed in the outer surface of the end wall 60 and a diametrically disposed slot 68 is likewise formed in the outer surface. The slot 68 is configured to receive a tool such as a screw driver to assist in inserting and securing the cartridge assembly 24 within the valve body 12. The counter bore 66 provides a recess to prevent potential damaging contact between the tool and the outlet orifice 62.

Figure 6:
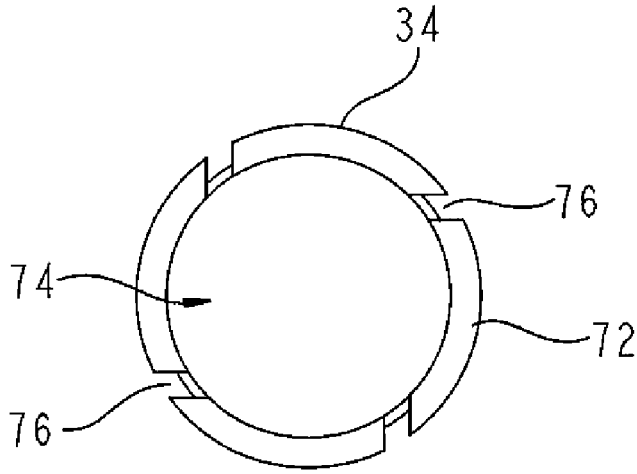
FIG. 6 is a top plan view of the whirl member of the cartridge assembly of FIG. 4.

A plurality of passageways 70 are formed within the holder 32 and are in fluid communication with the whirl member 34. As shown in FIGS. 5 and 6, the whirl member 34 includes an annular body 72 defining a central opening 74 and a plurality of outwardly extending slots 76 which are configured to impart rotational movement to water passing through the annular passageways 70, through the opening 74 intermediate the body 72 and the flow straightener 38, and out through the slot 76. Once the rotational movement is imparted to the water, it passes outwardly due to centrifugal force and contacts an outer cylindrical wall 78 of the back reflector 36. An end wall 79 of the back reflector 36 directs water in a rearward direction through a second annular passageway 80. An end wall 81 formed by the holder and the valve body then redirects the water back in a forward direction and toward a second outlet 82. In other words, the rotating water supplied from the whirl member 34 enters a serpentine passageway that reverses its direction twice as it travels toward the second outlet 82. This redirection of the water in rearward and forward directions assists in making the layer of water substantially uniform. As the water exits the second outlet 82, centrifugal force causes it to define a substantially continuous shield of water 84 having a sheet-like appearance (FIG. 7). In order to reduce turbulence and assist in providing a continuous sheet of water within the shield 84, the surfaces contacted by the rotating water should be substantially smooth. The shield 84 will typically have a conical or bulb-like shape.

Figure 10:
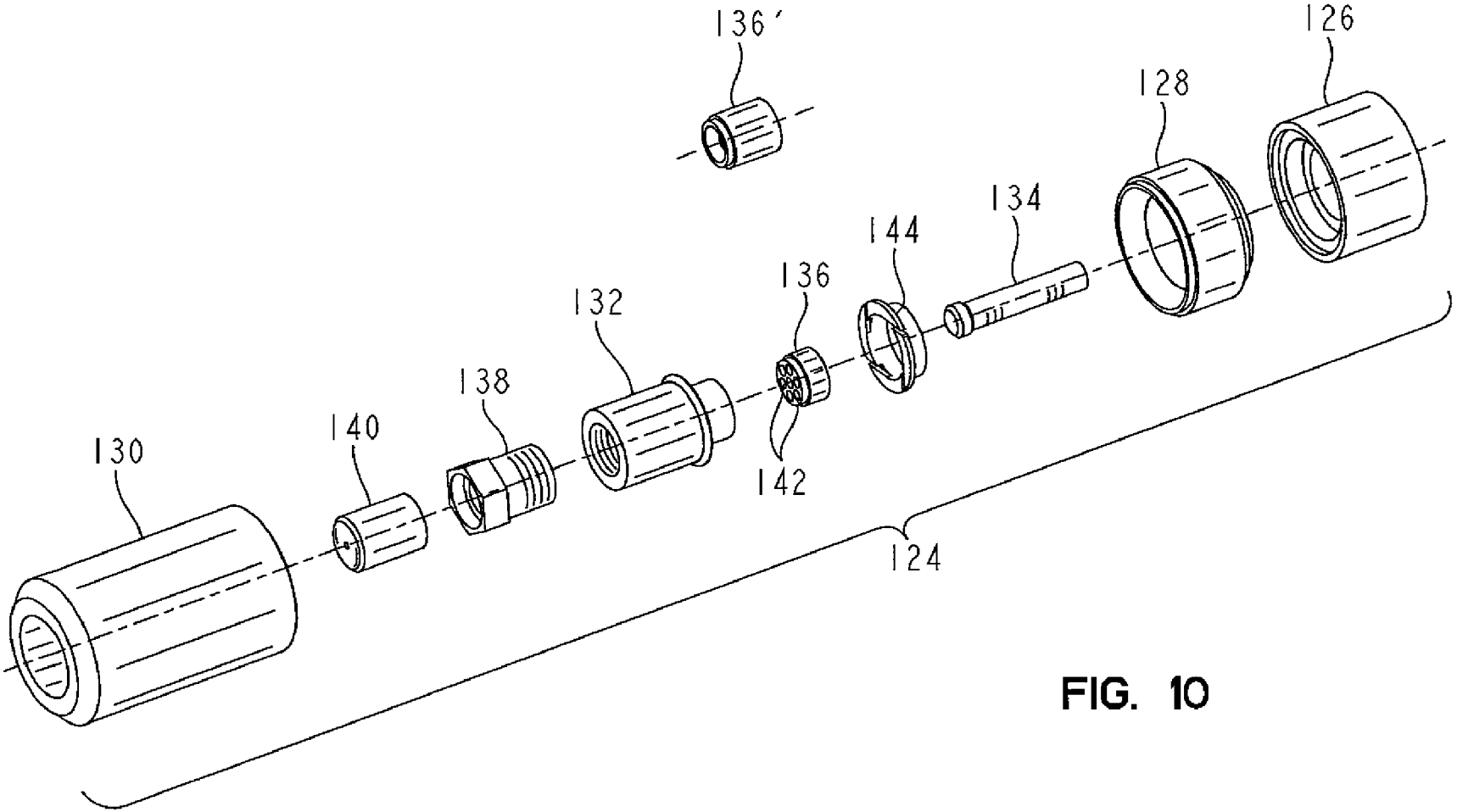
FIG. 10 is an exploded perspective view of a further illustrative embodiment cartridge assembly of the present disclosure.
Figure 11:
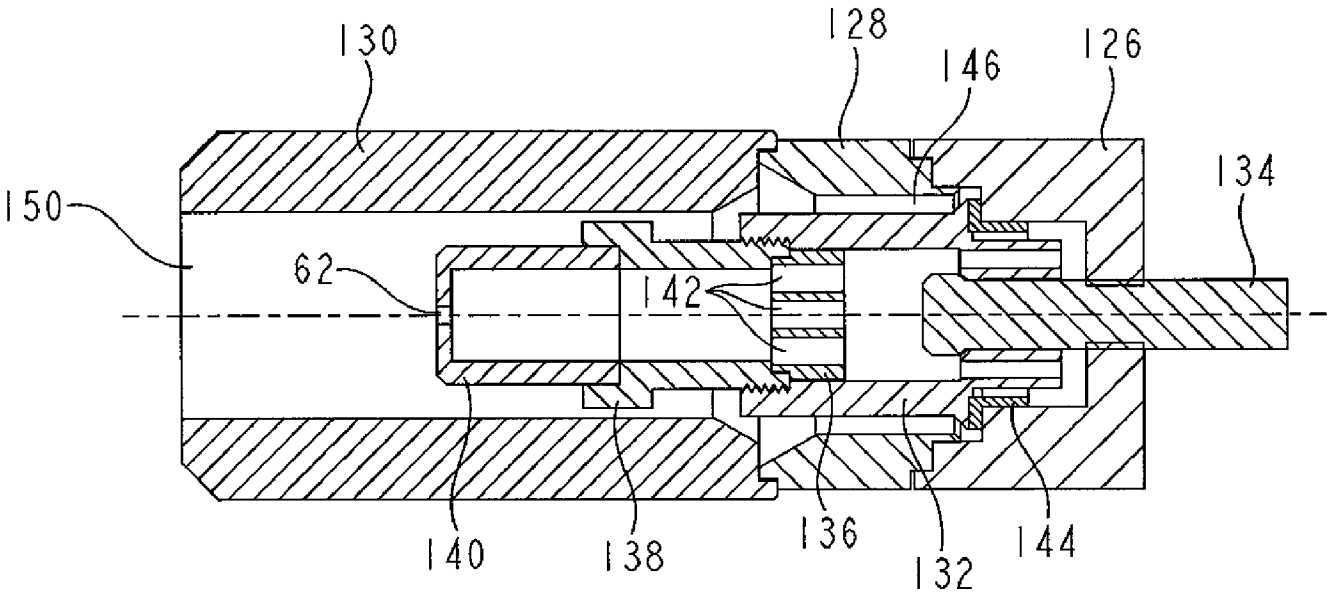
FIG. 11 is a cross-sectional view of the cartridge assembly of FIG. 10.
Figure 12:
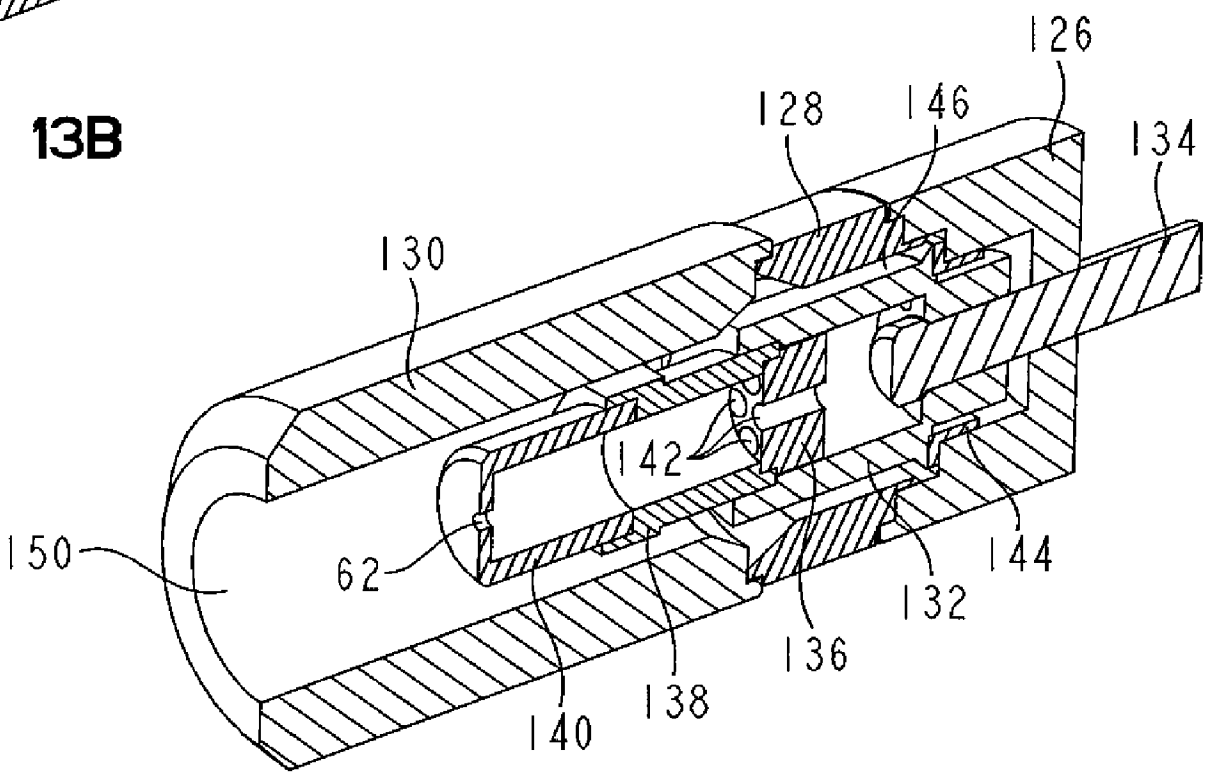
FIG. 12 is a perspective view with a cut-away thereof of the cartridge assembly of FIG. 10.

Turning now to FIGS. 10-12, a further illustrative embodiment of the valve cartridge assembly 124 of the present invention is illustrated. The valve cartridge assembly 124 includes a base 126 which threadably receives a shroud 128. Similarly, a shroud shaper 130 threadably receives the shroud 128. A nozzle mount 132 is operably coupled to the base 126 through a conventional fastener, such as a screw 134. A flow straightener 136 is concentrically received within the nozzle mount 132. The flow straightener 136 is secured in position by means of a nozzle body 138 which is threadably received within an outer end of the nozzle mount 132. A nozzle 140 is threadably received within an outer end of the nozzle body 138.

The nozzle mount 132 and the flow straightener 136 cooperate to assist in removing turbulence from water flowing therethrough. More particularly, the flow straightener 136 includes a plurality of parallel bores 142 (see FIG. 11) configured to cause a substantially linear flow of water therethrough. The nozzle 140 is of a design similar to nozzle 40 detailed herein.

Figure 13A:
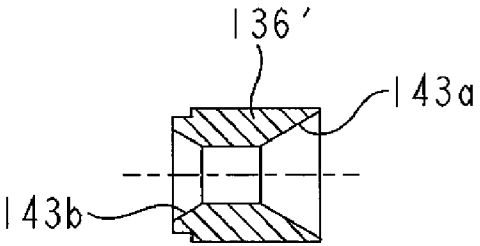
FIG. 13A is a cross-sectional view of an illustrative flow straightener.
Figure 13B:
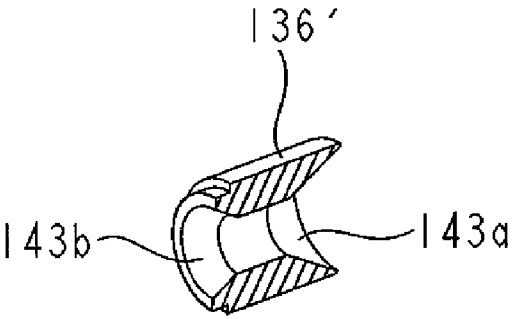
FIG. 13B is a perspective view with a cutaway thereof of the flow straightener of FIG. 13A.

Referring to FIGS. 13A and 13B, an alternative embodiment flow straightener 136' includes an inwardly facing conical surface 143*a* and an outwardly facing conical surface 143*b*. The flow straightener 136' may be substituted for flow straightener 136 to facilitate the removal of turbulence from water passing therethrough.

A whirl member 144 is retained within the base 126 by the nozzle mount 132. The whirl member 144 may be of a design similar to whirl member 34 as detailed herein. As note above, the whirl member 144 is configured to impart rotational movement to water passing therethrough, wherein the water then extends into an annular passageway 146 and into the shroud shaper 130. Because the water adheres to the inner surface of the outer wall of the shroud shaper 130 it generates a conical or bulb-like continuous shield of water as it exits through outlet 150. As detailed above, the outlet orifice 62 of the nozzle 140 generates a center stream of water disposed within the shield of water.

Figure 14:
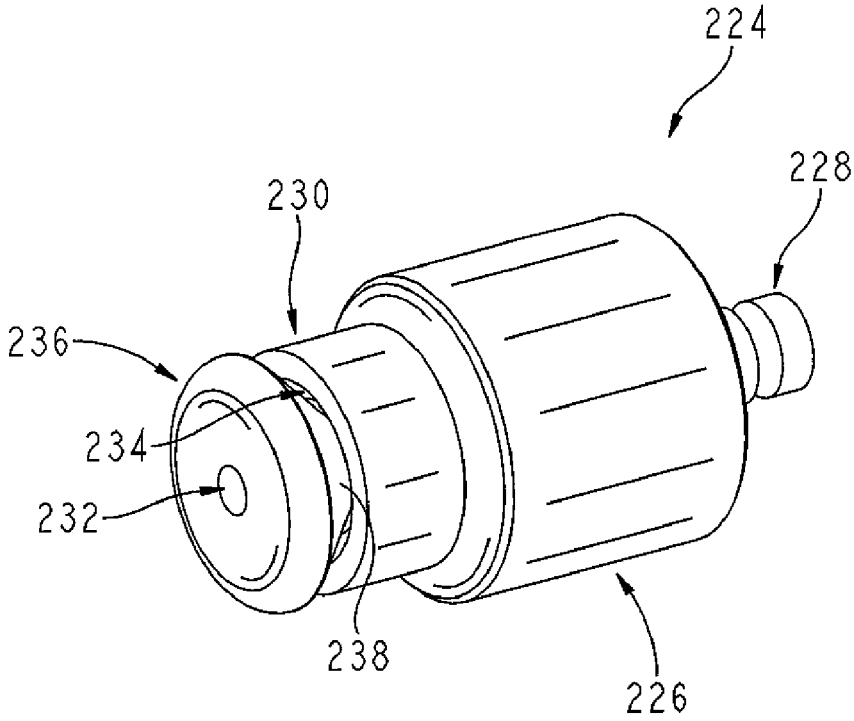
FIG. 14 is a perspective view of a further illustrative embodiment cartridge assembly.
Figure 15:
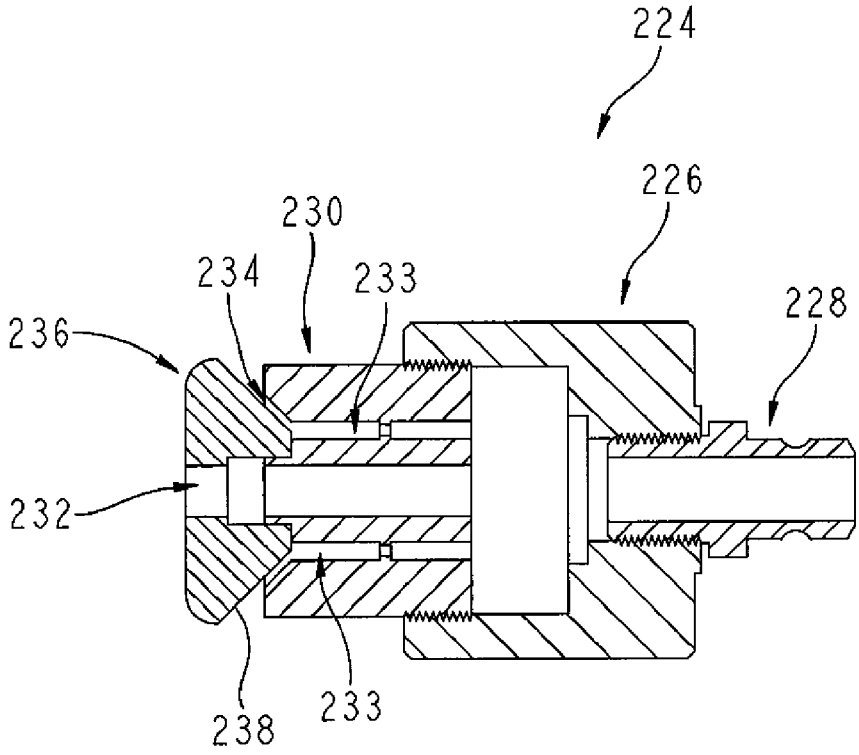
FIG. 15 is a cross-sectional view of the cartridge assembly of FIG. 14.
Figure 16:
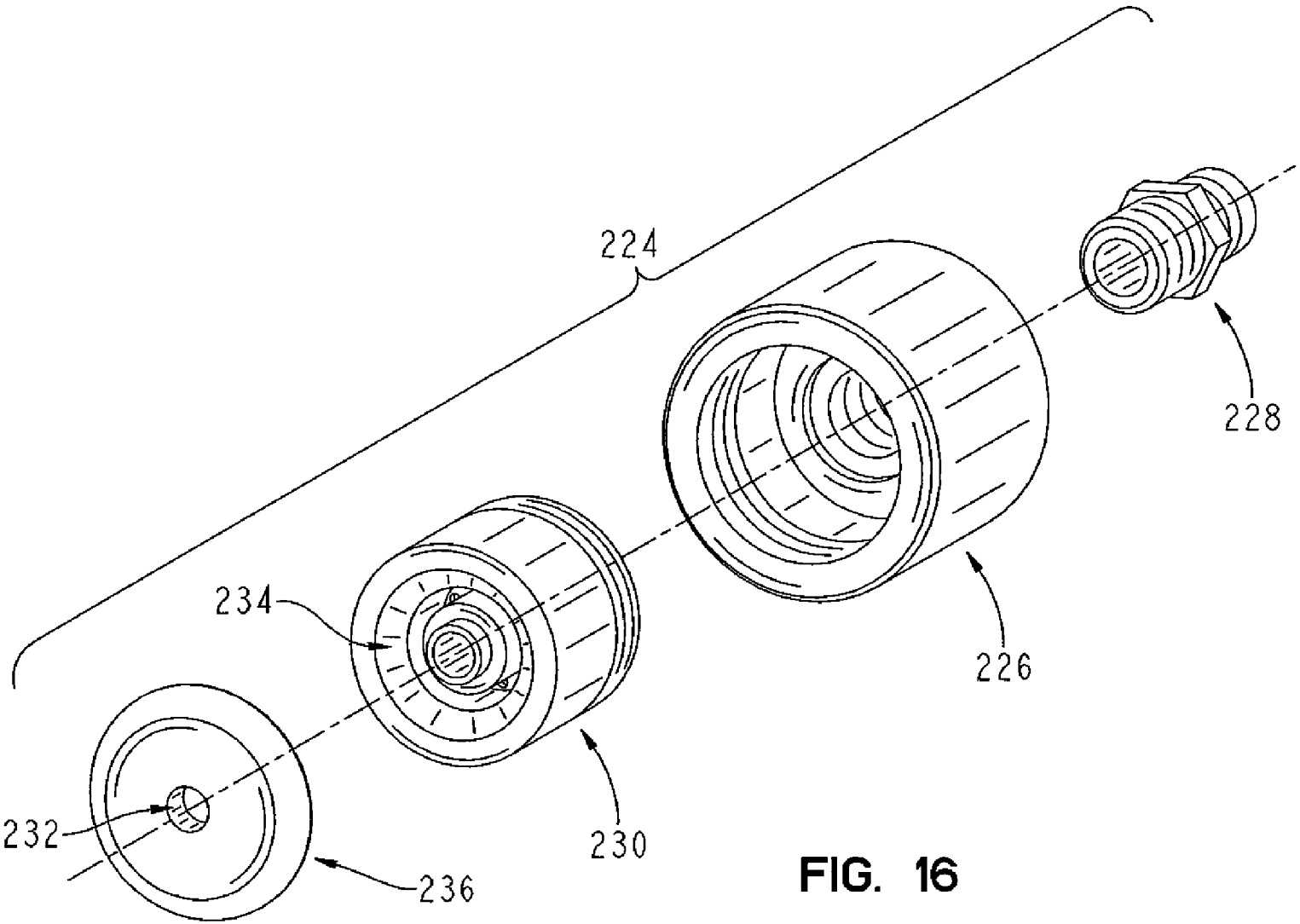
FIG. 16 is an exploded perspective view of the cartridge assembly of FIG. 14.

FIGS. 14-16 show another illustrative embodiment cartridge assembly 224 of the present invention. Cartridge assembly 224 includes a base 226 having an inlet 228. Inlet 228 is illustrated as a separate component coupled to base 226. However, inlet 228 may be integrally formed as apart of base 226. A nozzle 230 is threadably received within the base 226 and includes a center first outlet 232 and an annular second outlet 234 disposed concentrically around the first outlet 232. A conical member 236 is supported concentrically around the center first outlet and provides a Coanda effect surface 238. More particularly, water passing through the inlet 228 to the center first outlet 232 generates a water stream which is illustrated as centrally located. Water passing through passageways 233 in nozzle 230 and onto the annular second outlet 234 contacts the Coanda effect surface 238 of the conical member 236. A Coanda effect results in adhesion of the water to the surface 238 by surface tension, such that the water passing beyond the conical member 236 produces a substantially continuous shield of water in a sheet-like manner around the center water stream.

Figure 17:
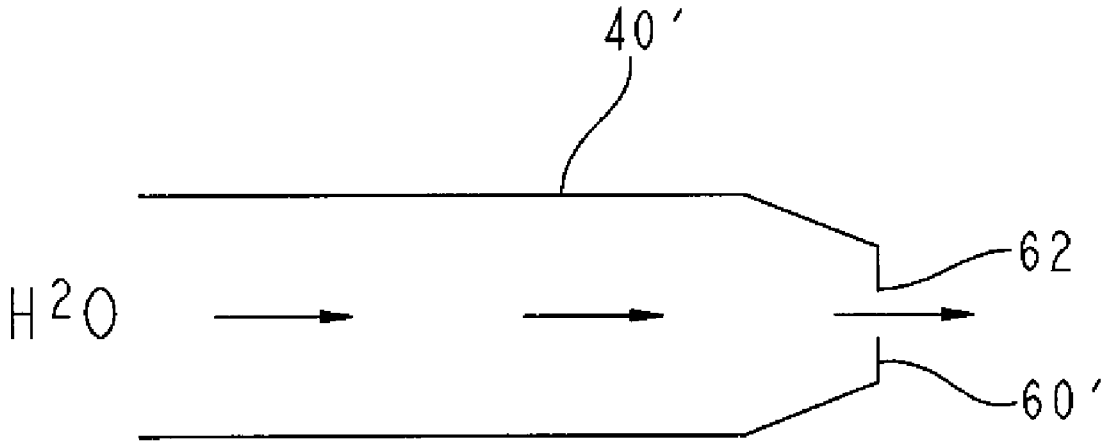
FIG. 17 is a representative view of a further embodiment nozzle.

FIG. 17 illustrates an alternative embodiment for producing a substantially laminar flow through the outlet orifice 62 of a nozzle 40'. In this embodiment, instead of a substantially planar end wall 60, the end wall 60' includes a conical surface directing water to the outlet orifice 62.

It should be appreciated that the substantially laminar flow of the center stream 63 reduces splashing or misting in response to water contacting a surface 280. Additionally, the water shield 84 protects against splash, mist and dislodged debris when using a power spray to clean surfaces, such as dishes, sink, etc. It is also possible to replace the continuous water shield with an aerated shield.

As discussed herein, the various illustrated embodiments provide a central flow of water having a generally laminar stream, such as stream 63 in FIG. 7, and a continuous shield of water, such as shield 83 in FIG. 7, surrounding the central flow of water. The continuous shield of water may also surround a flow of water, central or offset, having a substantially non-laminar stream.

Figure 18:
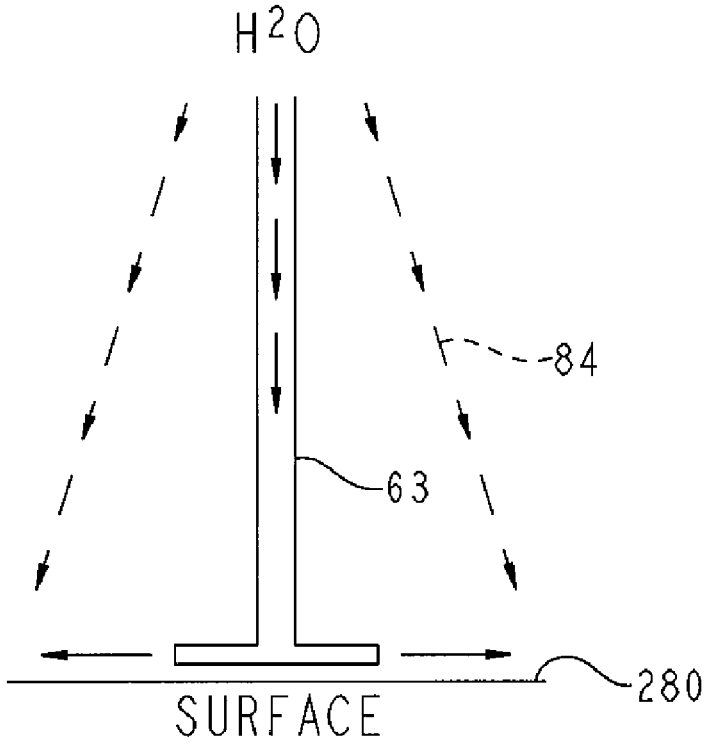
FIG. 18 is a side, schematic view showing an illustrative velocity circle formed by a substantially laminar stream.
Figure 19:
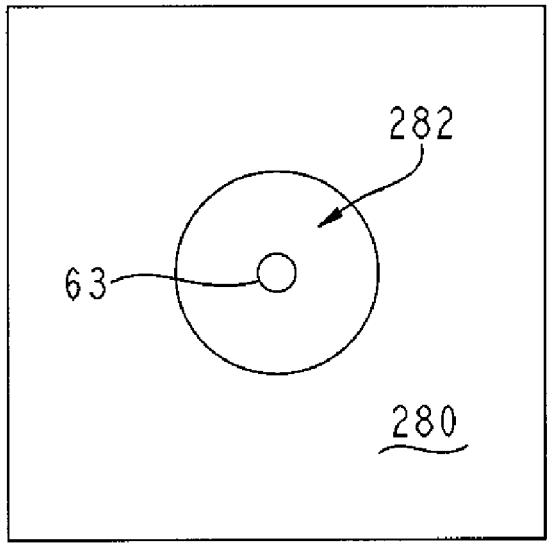
FIG. 19 is a top, schematic view showing an illustrative velocity circle formed by a substantially laminar stream.

Referring to FIGS. 18 and 19, substantially laminar stream 63 is surrounded by shield 84, which essentially acts as a splash barrier. As substantially laminar stream 63 impacts surface 280 (such as a surface of a dish), fluid follows surface 280 in a direction radially outwardly from the center axis of stream 63. More particularly, the substantially laminar characteristics of stream 63 and the Coanda effect causes the fluid to generate a velocity zone 282, substantially circular, which extends outwardly to mix with fluid from shield 84 impacting surface 280. When substantially laminar stream 63 contacts surface 280, it creates a substantially circular zone 282 (illustratively about 1 inch in diameter) that is of a high pressure and flows parallel to surface 280. Water flow within zone 282 thus tends to strip particles from surface 280 to facilitate cleaning, similar to a mechanical scraping. Further, fluid from stream 63 and from shield 84 combine to form a turbulent flow which also facilitates cleaning of surface 280.

Figure 20:
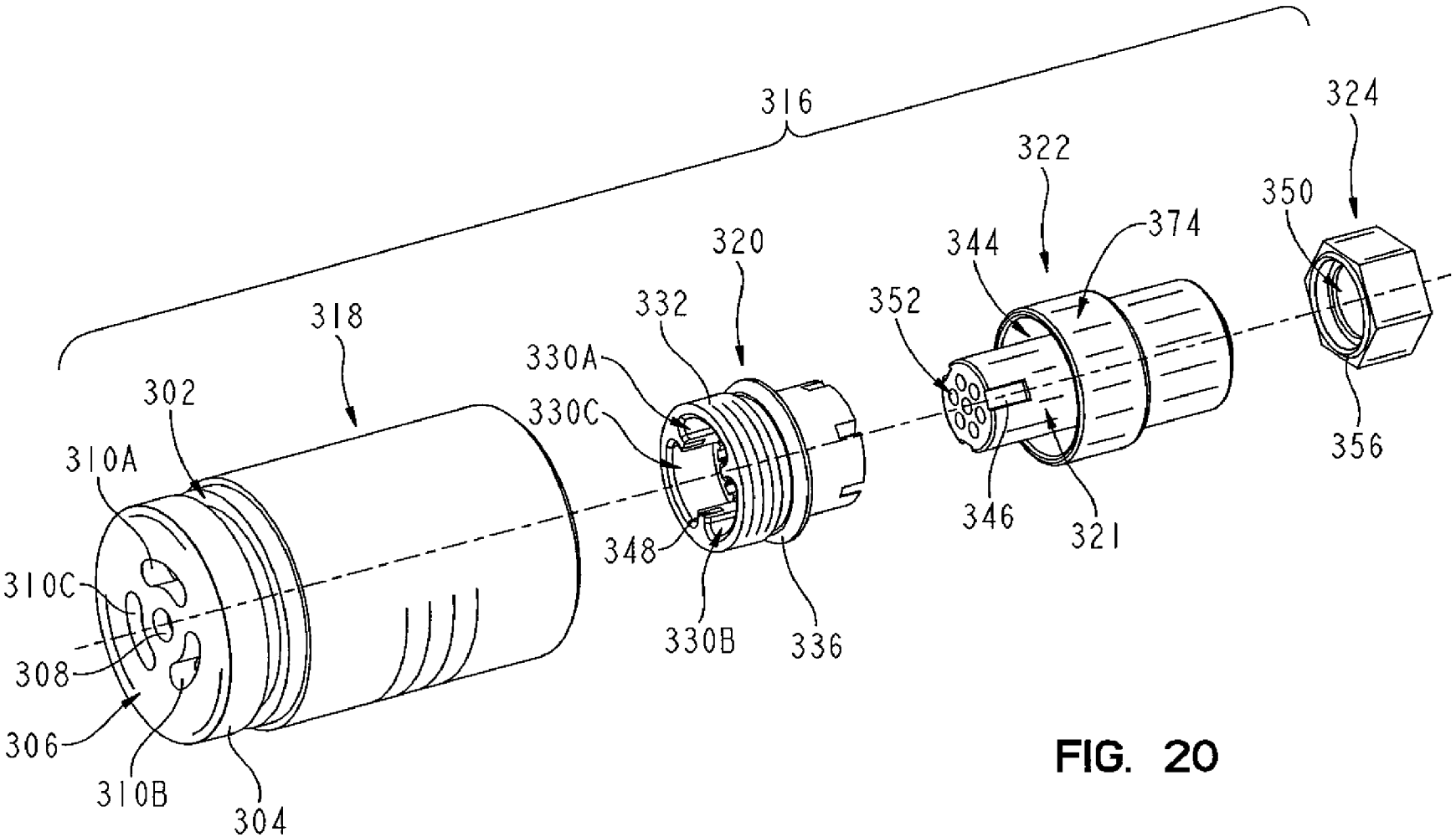
FIG. 20 is an exploded perspective view of a further embodiment cartridge assembly.
Figure 21:
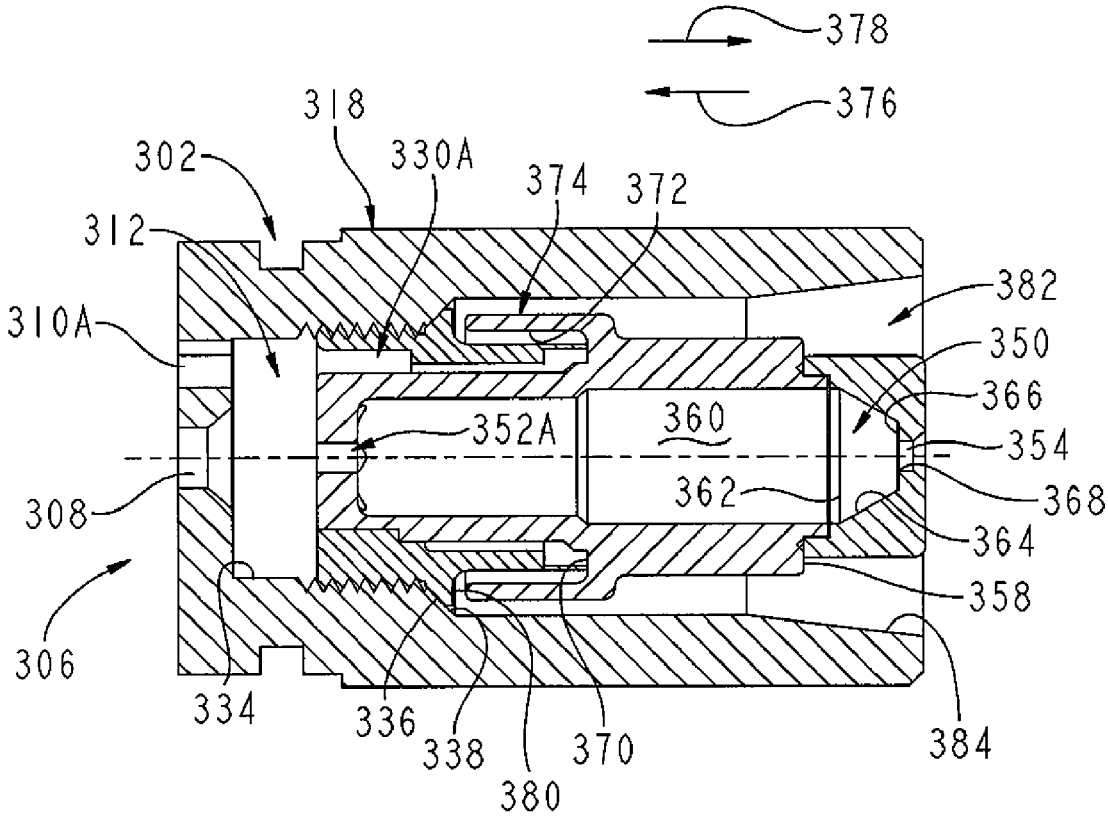
FIG. 21 is a cross-sectional view of the cartridge assembly of FIG. 20.
Figure 22:
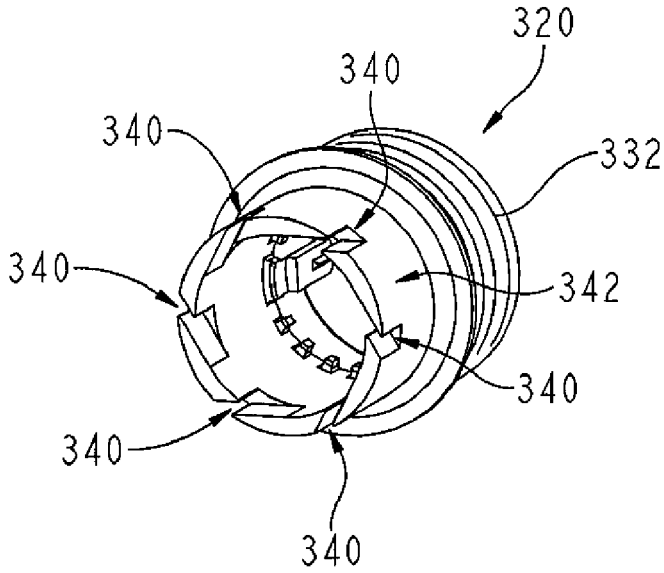
FIG. 22 is a perspective view of an inlet member of the cartridge assembly of FIG. 20.

Referring to FIGS. 20-22 a further embodiment cartridge assembly 316 is shown. Cartridge assembly 316 may be received in valve body 12 and includes a holder 318, an inlet member 320, a flow straightener 322, and an outlet member 324. As explained herein outlet member 324 provides a substantially laminar flow of water. Surface 304 of holder 318 cooperate with valve body 12 to couple cartridge assembly 316 to valve body 12. In one embodiment, a coupler, such as a fastener, is received in opening 308 to couple holder 318 to valve body 12. In one embodiment, surface 304 is threaded and is threadably engaged with valve body 12 to permit removal of valve cartridge 316 from valve body 12. A seal (not shown) is carried in a recess 302 of holder to provide a fluid tight seal between valve body 12 and a periphery of holder 318.

Holder 318 includes an inlet 306 which is in fluid communication with the internal fluid passageways of valve body 12. Illustratively inlet 306 includes three elongated orifices 310A-C. Inlet 306 may have fewer or more orifices. Referring to FIG. 21, orifices 310A-C (310A illustrated) are generally aligned with passageways 330A-C formed by the cooperation of inlet member 320 and flow straightener 322. Orifices 310A-C are in fluid communication with a region 312 in holder 318 between holder 318 and inlet member 320.

Inlet member 320 is coupled to holder 318. In one embodiment surface 332 of inlet member 320 and surface 334 of holder 318 are each threaded. In one embodiment, surfaces 332 and 334 are sized such that holder 318 and inlet member 320 may be sonically welded together. An angled surface 336 of inlet member 320 and an angled surface 338 of holder 318 cooperate to assist in sealing the periphery of inlet member 320 relative to holder 318.

Surfaces 348 (illustratively three surfaces) of flow straightener 322 and surfaces 348 (illustratively three surfaces) of inlet member 320 are sized such that flow straightener 322 may be sonically welded to inlet member 320. In one embodiment, flow straightener 322 is coupled to inlet member 320 by other suitable means, such as threads.

Referring to FIG. 22, inlet member 320 includes a plurality of slot 340 are in fluid communication with passageways 330 and which impart a rotational movement to the water to assist in the formation of the continuous shield of water, as explained below. The central portion of inlet member 320 receives a body portion 321 of flow straightener 322. A lower portion 342 of inlet member 320 which contains slots 340 is received within an opening 344 of flow straightener 322 between body portion 321 and a deflector portion 374 of flow straightener 322.

Outlet member 324 includes a recess 350 which is in fluid communication with fluid passages 352 in flow straightener 322. Recess 350 terminates in an outlet orifice 354. Outlet member 324 includes a raised portion 356 which cooperates with a surface 358 of flow straightener 322 to permit outlet member 324 to be sonically welded to flow straightener 322. In one embodiment, flow straightener 322 is coupled to outlet member 324 by other suitable means, such as threads.

In operation, water enters valve cartridge 316 through orifices 310A-C. As explained herein, a first portion of the water entering valve cartridge 316 exits as a stream of water, similar to stream 63, and a second portion of the water entering valve cartridge 316 exits as a continuous shield of water, similar to shield 84.

Body portion 321 of flow straightener 322 includes a plurality of passageways 352. Illustratively passageways 352 are a plurality of parallel, longitudinally aligned bores (see 352A in FIG. 21) which are configured to assist in removing turbulence from fluid flowing there through, and provide a more linear flow to the fluid. Water passing through passageways 352 is communicated to an internal waterway 360 in flow straightener 322 and onto recess 350 in outlet member 324. Recess 350 includes a cylindrical outer wall 362 and a tapered or conical inner wall 364. Conical inner wall 364 abuts a substantially planar end wall 366 defining outlet orifice 354, such that water passing there through forms a center water stream similar to stream 63. Orifice 354 includes sharp entry corners 368 to assist in providing a substantially laminar flow to the outlet stream. In one embodiment, the outlet stream has a substantially laminar flow.

A continuous shield of water is formed by water that enters passageways 330A-C formed by inlet member 320 and flow straightener 322. Passageways 330A-C are in fluid communication with slots 340 positioned at a lower end of inlet member 320. Slots 340 and a lower surface 370 of flow straightener 322 change the direction of flow of the water and impart rotational movement to the water passing there through. Once the rotational movement is imparted to the water, it moves outwardly to a side wall 372 of deflector member 374 of flow straightener 322 and is directed backwards in direction 376. The water continues generally in direction 376 until it is redirected forward again in direction 378 by surface 380 of inlet member 320. The water travels generally in direction 378 toward a shield outlet 382.

As the fluid moves toward shield outlet 382, centrifugal force causes it to follow an inner surface 384 of holder 318. Due to the well-known Coanda effect, where fluid flowing along a solid surface which is curved slightly from the stream tends to follow the surface, the fluid defines a substantially continuous shield of fluid, generally similar to shield 84 having a sheet-like appearance. As shown in FIG. 21, inner surface 384 illustratively includes a flared or angled portion extending toward shield outlet 382. In order to reduce turbulence and to assist in providing a continuous sheet of water within the shield, inner surface 384 contacted by the rotating fluid should be substantially smooth.

The flared portion of surface 384 assists in shaping the appearance of the continuous sheet of water. The flared portion causes the appearance of the continuous sheet of water to be more conical and less spherical.

Additional details regarding cartridge assembly 316 are provided in U.S. Provisional Patent Application Ser. No. 60/771,192, filed Feb. 6, 2006, the disclosure of which has been expressly incorporated by reference herein.

Figure 23:
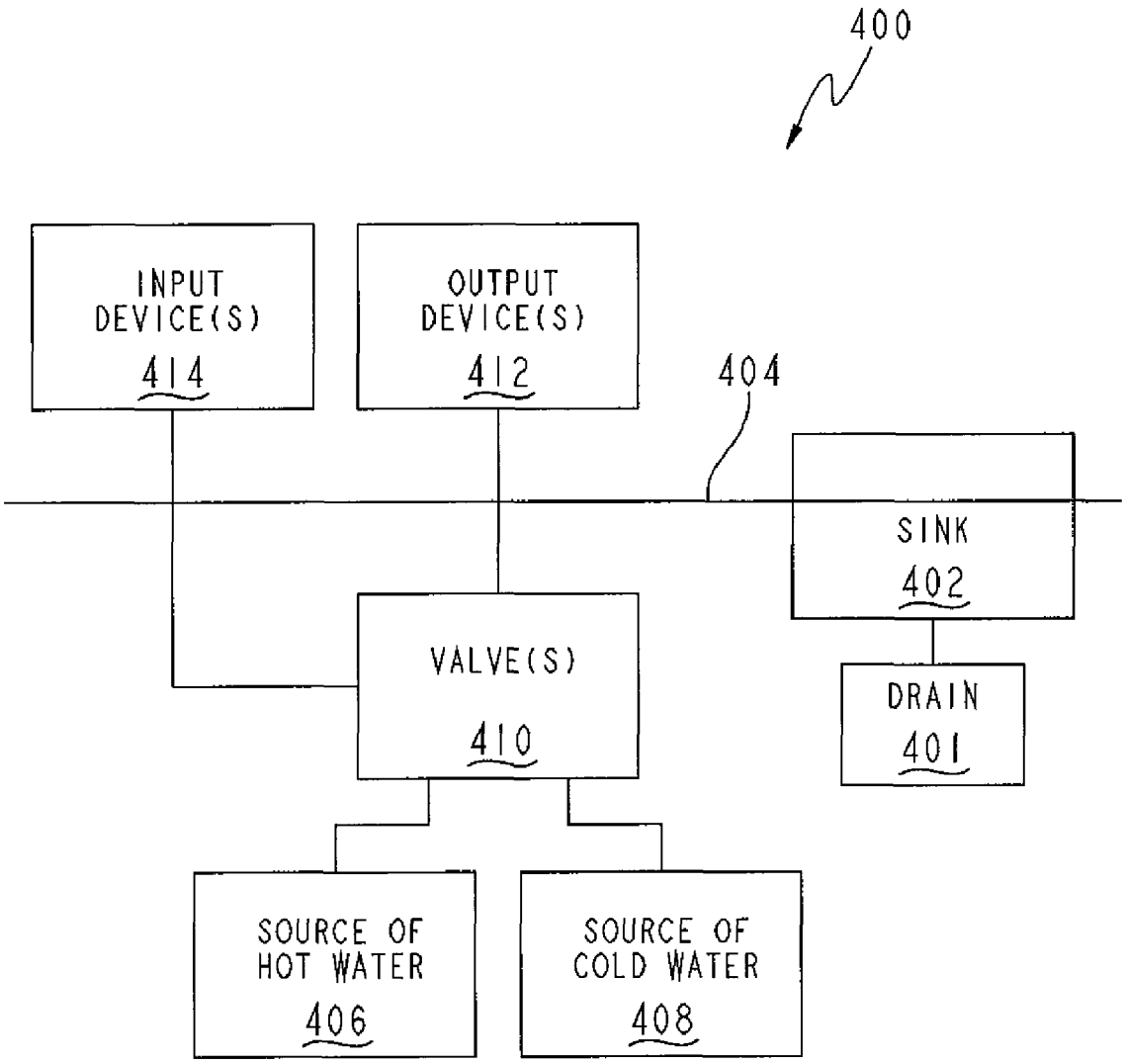
FIG. 23 is a diagrammatic view of an exemplary water delivery system.

As illustrated in FIG. 23, the spray heads and valve cartridges discussed herein may be used as apart of a water delivery system 400 for use with a sink 402 having a drain 401 or other device, residential or commercial, associated with a drain. Sink 402 is shown being coupled to a countertop 404. The countertop 404 and a top portion of the sink 402 are collectively referred to as the sink deck. Water delivery system 400 is coupled to a source of hot water 406 and a source of cold water 408. Water from the source of hot water 406 and source of cold water 408 are provided to one or more valves 410 which may be adjusted to regulate the flow of water there through.

In one embodiment, the source of hot water 406 and the source of cold water 408 are both in fluid communication with a single mixing valve which regulates the flow rate of water from each source 406, 408 which is to be provided to an output device 412, if any depending on the water characteristics desired. For instance, only hot water may be desired so the valve would only pass water from the source of hot water 406. In another embodiment, the source of hot water 406 and the source of cold water 408 are each in fluid communication with a respective valve; each valve regulating the flow of water to be provided to the output device 412 from the respective source of water in fluid communication with the valve. Valve 410 may be positioned above the sink deck or below the sink deck.

The control of valve 410 is through one or more input devices 414. Exemplary input devices 414 include both mechanical input devices, such as handles, and electronic input devices, such as a touch sensor or an infrared sensor, which provide an indication to a controller of the water characteristics desired. In one example, the controller adjusts valve 410 through a motor coupled to valve.

Exemplary output devices 412 include a spout having a spray head coupled thereto. The spout may be rigid or may have a flexible portion. In one embodiment, spray head is a swivel head attached to the end of a spout base member. In one embodiment, spray head is a pull out wand which is attached to a spout base member. The pull out wand having a first position generally coupled to spout base member and a second position wherein the wand is spaced apart from the spout base member and connected thereto through a waterway connecting the two. Another exemplary output device is a side spray. Exemplary side sprays are disclosed in U.S. Provisional Application Ser. No. 60/771,192, filed Feb. 6, 2006, the disclosure of which is expressly incorporated by reference herein. In one embodiment, spray head is incorporated into a side spray which may be coupled to the sink deck and is in fluid communication with valve 410. In one example side spray is in fluid communication with valve 410 independent of a spout. In one embodiment, spray head may be used with any type of water delivery device which is coupled to a sink deck and used in combination with a sink 402.

In one embodiment, water delivery system 400 is associated with a bathtub, a shower, or other receptacle having an associated drain, such as drain 401 associated with sink 402 in FIG. 23. As such, the spray heads and/or valve cartridges disclosed herein may be used to provide a continuous shield surrounding a stream of water as part of a tub filler, a showerhead, and/or a body spray.

In one example, using the continuous shield and stream combination may reduce the amount of steam produced in a shower setting. In effect, a portion of air may be trapped between the stream and the continuous shield. As such, steam generated from the stream is generally trapped inside the shield thereby limiting the humidity in the bathroom.

In one embodiment, the spray heads and/or valve cartridges disclosed herein may be configured to include multiple streams of water surrounded by the continuous stream. Each stream may have a substantially laminar flow or a non-laminar flow. In one embodiment, the spray heads and/or valve cartridges disclosed herein may be configured to include multiple continuous shields of water. In one embodiment, the spray heads and/or valve cartridges disclosed herein may be configured to include one or more streams of the water, each stream having one of a substantially laminar flow or a non-laminar flow, and one or more continuous shields of water surrounding the one or more streams of water.

In one embodiment, the inlet to the water passage to generate the stream of water and the inlet to the water passage to generate the shield of water are independent of each other, such that water may be presented to only the water passage to generate the stream of water, to only the water passage to generate the shield of water, or to both the water passage to generate the shield of water and the water passage to generate the stream of water. The water delivery system 400 may include separate water conduits from valve 410 connecting to the water passage to generate the stream of water and the water passage to generate the shield of water. As such, a user may select with input device 414 to generate a stream of water only, to generate a shield of water only, or to generate a combination of a stream of water and a continuous shield of water. In one example, the water shield only mode may be used for a rinsing application.

In one embodiment, the continuous shield of water has a generally football shaped appearance. In one embodiment, the shape of the continuous shield of water is influenced by the pressure of the water. At standard pressures for residential applications, the shape of the continuous shield is generally a half of a football or generally conical. At lower pressures the shape of the continuous shield is generally football shaped. As such, the pressure related to the water in the continuous shield may be chosen to select an aesthetically pleasing appearance. In one example, the pressure is chosen such that the appearance of the water shield provides a bubble around a stream of water. The shape of the continuous shield may also be influenced by the temperature of the water.

Although the invention has been described in detail with reference to certain preferred embodiments, variations and modifications exist within the spirit and scope of the invention as described and defined in the following claims.

The invention claimed is:

1. A spray head comprising:

a body including a fluid port configured to be coupled to a water supply; and a cartridge received within the body, the cartridge including an inlet in fluid communication with the fluid port, a first outlet in fluid communication with the inlet and configured to produce from the spray head a water stream, a second outlet having a longitudinal axis and a fluid contact surface extending around the longitudinal axis and in fluid communication with the inlet, a whirl member configured to impart rotational movement about the longitudinal axis to water passing from the inlet to the second outlet, such that centrifugal force causes the water moving toward the second outlet to follow the fluid contact surface, and a reflector positioned intermediate the whirl member and the fluid contact surface to reverse the direction of water supplied from the whirl member, the direction of water again reversed from the reflector to the fluid contact surface to assist in providing uniform water flow to the fluid contact surface, wherein a continuous shield of water extends outwardly from the spray head in a sheet-like layer around the water stream and is spaced apart from the water stream, the water stream produced from the spray head by the first outlet having a substantially laminar flow.

2. The spray head of claim 1, wherein the first outlet is defined by a nozzle including a planar wall disposed perpendicular to the flow of water and an orifice formed within the wall.

3. The spray head of claim 2, wherein the wall has a thickness less than the diameter of the orifice.

4. The spray head of claim 2, further comprising a flow straightening member in fluid communication with the nozzle and configured to assist in removing turbulence from the water supplied to the orifice.

5. The spray head of claim 4, wherein the flow straightening member includes a plurality of parallel bores configured to provide a substantially linear flow of water.

6. The spray head of claim 1, wherein the cartridge is threadably coupled to the body.

7. The spray head of claim 1, wherein an annular passageway couples the inlet to the whirl member.

8. The spray head of claim 1, wherein the whirl member includes an annular body having a plurality of slots formed therein to rotate water outwardly about the longitudinal axis.

9. The spray head of claim 1, wherein the cartridge includes a discharge member including the fluid contact surface configured to produce the continuous shield of water through a Coanda effect.

10. The spray head of claim 9, wherein the fluid contact surface of the discharge member has a conical shape.

11. The spray head of claim 1, wherein the water stream produced by the first outlet is generally positioned at a center of the continuous shield of water produced by the second outlet.

12. The spray head of claim 11, wherein the continuous shield of water produced by the second outlet is at least one of substantially conical shaped and bulb shaped.

13. A spray head comprising:

a body including a fluid port;

a mount removably received within the body;

a flow straightening member operably coupled to the mount and in fluid communication with the fluid port, the flow straightening member being configured to assist in removing turbulence from water;

a nozzle operably coupled to the straightening member and including an outlet orifice configured to produce from the spray head a center water stream; and a whirl member operably coupled to the mount and extending around the flow straightening member, the whirl member including a body having a plurality of slots, a fluid passageway defined between the body of the whirl member and the flow strengthening member and in fluid communication with the fluid port, wherein the slots of the whirl member are configured to impart rotational movement to water supplied to a serpentine passageway between the whirl member and a fluid contact surface, such that water from the whirl member follows the fluid contact surface for producing from the spray head a continuous shield of water extending around the center water stream and spaced apart from the center water stream.

14. The spray head of claim 13, wherein the nozzle includes a cylindrical outer wall and the outlet orifice is formed within a planar wall disposed perpendicular to the outer wall to render the water stream passing therethrough substantially laminar.

15. The spray head of claim 14, wherein the planar wall has a thickness less than the diameter of the orifice.

16. The spray head of claim 15, wherein the flow straightening member includes a plurality of parallel bores configured to provide a substantially linear flow of water.

17. The spray head of claim 13, wherein an annular passageway couples the inlet to the whirl member.

18. The spray head of claim 17, wherein the whirl member includes an annular body having a plurality of slots formed therein rotate water outwardly about a longitudinal axis defined by the outlet orifice.

19. The spray head of claim 13, further comprising a back reflector concentrically received around the whirl member.

20. The spray head of claim 13, further comprising a second annular outlet concentrically received around the outlet orifice and configured to receive water from the whirl member and produce the continuous shield of water.

21. A method of generating a water pattern comprising the steps of:

supplying water to a cartridge assembly having a first outlet and a second outlet;

producing from the first outlet a center water stream having a substantially laminar flow; and producing from the second outlet an outer continuous shield of water extending outwardly in a sheet-like layer around the center water stream and spaced apart from the center water stream, including the steps of imparting rotational movement to the water, providing substantially uniform flow to the water by reversing a plurality of times the direction of water flow, and causing the rotating water to follow a fluid contact surface within the second outlet.

22. The method of claim 21, further comprising the step of producing from the first outlet a center water stream includes the step of removing turbulence from the center water stream to make it substantially laminar.

23. The method of claim 21, wherein the step of producing from the second outlet an outer continuous shield of water further includes the step of passing the water over a conical shaped surface.

24. A method of generating a water pattern with a water delivery device comprising the steps of:

dividing a supply of water provided to the water delivery device into at least a first portion and a second portion; and supplying from an exterior of the water delivery device a stream of water based on the first portion and a continuous shield of water based on the second portion, the stream of water having a substantially laminar flow and the continuous shield of water rotating about a longitudinal axis of the stream of water and spaced apart from the stream of water, the continuous shield of water having a substantially uniform flow by reversing a plurality of times the direction of flow.

25. The method of claim 24, further comprising the step of passing the first portion of the water through a flow straightener having a plurality of longitudinal passageways, the flow straightener configured to remove turbulence from the first portion of the water.

26. The method of claim 24, further comprising the step of imparting a rotational movement to the second portion of the water.

27. The method of claim 26, further comprising the steps of directing the second portion of the water generally in a first direction followed by, directing the second portion of the water generally in a second direction opposite the first direction followed by, directing the second portion of the water generally in the first direction again.

28. The method of claim 26, wherein the second portion of the water contacts a Coanda effect surface.

* * * * *